US006438335B1

(12) United States Patent
Kinouchi et al.

(10) Patent No.: US 6,438,335 B1
(45) Date of Patent: Aug. 20, 2002

(54) FIXING DEVICE WITH IMPROVED HEAT CONTROL FOR USE IN AN IMAGE FORMING APPARATUS

(75) Inventors: Satoshi Kinouchi, Tokyo; Osamu Takagi, Chofu, both of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/666,786

(22) Filed: Sep. 21, 2000

(30) Foreign Application Priority Data

Sep. 24, 1999 (JP) ..... 11-270897

(51) Int. Cl.[7] ..... G03G 15/20
(52) U.S. Cl. ..... 399/67; 219/619; 399/328
(58) Field of Search ..... 399/33, 67, 69, 399/70, 330, 331, 328; 219/619, 667, 668

(56) References Cited

U.S. PATENT DOCUMENTS

| | | | | |
|---|---|---|---|---|
| 5,752,150 A | | 5/1998 | Kato et al. | 399/330 |
| 5,915,147 A | * | 6/1999 | Kouno et al. | 399/69 |
| 6,026,273 A | | 2/2000 | Kinouchi et al. | 399/328 |
| 6,078,781 A | | 6/2000 | Takagi et al. | 399/330 |
| 6,087,641 A | | 7/2000 | Kinouchi et al. | 219/619 |

FOREIGN PATENT DOCUMENTS

| | | | |
|---|---|---|---|
| JP | 8-76620 | | 3/1996 |
| JP | 9-197854 | | 7/1997 |
| JP | 9-258586 | | 10/1997 |
| JP | 11-119588 | * | 4/1999 |
| JP | 11-143269 | * | 5/1999 |

* cited by examiner

*Primary Examiner*—Joan Pendegrass
(74) *Attorney, Agent, or Firm*—Foley & Lardner

(57) ABSTRACT

The fixing device fixes toner to a paper by a nip between a heating roller and a press roller which are opposed to each other. An exciting coil is provided inside the heating roller. Temperature detection mechanisms are provided at least two positions on the outer circumferential surface of the heating roller, between the exciting coil and a metal layer of the heating roller, or on the inner circumference of the exciting coil. Two of the temperature detection mechanisms are respectively provided at a center part and an end part in the lengthwise direction of the heating roller, with a predetermined angle inserted therebetween on the circumference of the metal layer of the heating roller. A data table is provided to detect the temperature of a wire material forming the exciting coil, from an extent of a temperature increase while the exciting coil is electrically conducted or an extent of a temperature decrease after the electric conduction to the exciting coil is stopped. The temperature increase and the temperature decrease are detected by each of the temperature detection mechanisms. If either the temperature increase or the temperature decrease deviates from a definition value held in the data table, the current electrically conducted to the exciting coil is shut off.

15 Claims, 13 Drawing Sheets

FIXING DEVICE WITH IMPROVED HEAT CONTROL FOR USE IN AN IMAGE FORMING APPARATUS

CROSS-REFERENCE TO RELATED APPLICATIONS

This application is based upon and claims the benefit of priority from the prior Japanese Patent Application No. 11-270897, filed Sep. 24, 1999, the entire contents of which are incorporated herein by reference.

BACKGROUND OF THE INVENTION

The present invention relates to a fixing device for fixing a toner image to a sheet material as a target to which the toner image should be fixed, in an image forming apparatus such as an electrostatic copying machine or a laser printer.

A fixing device incorporated in a copying machine using an electrophotographic process fixes a developer which is toner formed on a sheet material by heating and melting the developer. A method using a radiated heat by a halogen lamp (filament lamp) is being widely used as a method for heating toner, which is applicable to the fixing device.

In the method using a halogen lamp as a heat source, the following structure is being widely used. That is, a pair of rollers are provided so that a predetermined pressure can be applied to the sheet material and toner. At least one of the paired rollers is constructed in a hollow columnar shape, and the halogen lamp formed in a columnar shape is provided in the inner space of the roller. In this structure, the roller in which the halogen lamp is provided constructs an acting part (nip) at a position where this roller contacts the other roller, thereby to apply a pressure and a heat to the sheet material and toner which are guided to the nip. That is, the sheet material which is a paper is let pass through a fixing point as a press contact portion (nip) between a heat roller provided with the lamp and a press roller which rotates as a slave to the heat roller. The toner on the paper is thereby melted and fixed to the paper.

In a fixing device using a halogen lamp, light and heat from the halogen lamp are radiated in all circumferential directions so that the roller is heated entirely. In this case, the heat conversion efficiency is 60 to 70% in consideration of the loss caused when converting light into heat and the efficiency at which heat is transferred to the rollers by warming the air in the roller. Thus, it is known that the heat efficiency is low, the power consumption is high, and the warm-up time is long.

Therefore, a fixing device using a cylindrical heatproof film material has been put into practical use, in place of the heat roller and press roller. This structure is constructed by a heat generation member and a heatproof film which moves in tight contact with the heat generation member. Heat energy of the heat generation member is supplied from the film to a sheet material, by moving the heatproof film together with the sheet material with the film kept in tight contact with the heat generation member.

In this fixing device, it is necessary manage the temperature of a linear heat generation member, so that uniformity in manufacture and highly accurate temperature control during operation are required. In addition, the quantity of heat of the heat generation must be set to a high heat quantity in case of a high-speed copying machine. Therefore, the power consumption is so high that the costs cannot be reduced.

A fixing device which uses induction heating has a been proposed as a substitute for the methods using a halogen lamp or a heat-proof film. For example, Japanese Patent Application KOKAI Publication No. 8-76620 discloses an apparatus in which an electrically conductive film is heated by a magnetic field generation means and toner is fixed to a paper kept in tight contact with the conductive film. A heat generation belt (electrically conductive film) is inserted between a member forming part of the magnetic field generation means and a heat roller, thereby forming a nip.

Japanese Patent Application KOKAI Publication No. 9-258586 discloses a method in which a heat generation member having a coil wound around a core provided along the rotation axis of a fixing roller is used and an eddy current is let flow through the fixing roller, thereby to achieve heating.

In case of the fixing device of the induction heating type, a heating coil is used as a magnetic field generation mechanism. Although a method for controlling the temperature of the roller surface has been proposed, only insufficient temperature detection is carried out with respect to the heating coil inside the roller. That is, it is not possible to respond to a case where a part of the roller or film is abnormally heated due to abnormal heat generation of the coil as a heat generation member. Also, it is not respond to another case where a part of the coil is heated by radiation heat from the roller surface. For example, Japanese Patent Application KOKAI Publication No. 9-19785 discloses a structure in which a coil temperature detection means and a fuse are included in a holder which supports a coil. This structure functions without problems if the current flowing through the coil is uniform and the increase of the coil temperature is constant at any places. However, it is not possible to respond to a case where a part of the roller or film is abnormally heated.

This suggests that the temperature of the heat generation member must be managed to be uniform like the above-explained heating method using a film, so it cannot be a fixing device which is advantageous in view of the uniformity in manufacture and the highly accurate temperature control during operation.

That is, in the fixing devices of the induction heating type that have been proposed up to now, a temperature difference appears between a part (paper-passing part) where a paper passes and a part (non-paper-passing part) where no paper passes. The roller surface temperature increases particularly at the non-paper passing part, thereby the temperature increases at coil end portions due to radiation heat from the roller surface. As a result, the coil may receive a heat of a heat-proof temperature or more and may be damaged. Depending on the shape of the coil, the entire circumference of the roller cannot be uniformly heated in the circumferential direction of the roller, and a temperature difference may be caused in the circumferential direction of the roller. This factor restricts heat generation at the above-mentioned coil end portions. Therefore, there have been demands for a coil temperature detection means capable of detecting the temperature.

BRIEF SUMMARY OF THE INVENTION

The present invention has an object of providing a fixing device of an induction heating method, which has a temperature detection means capable of detecting the temperature of a coil regardless of the shape of the coil and which can uniformly heat the entire area of the outer surface of a roller to a uniform temperature within a short time.

The present invention provides a fixing device comprising: an endless member having a metal layer made of a conductive material; an electromagnetic induction coil provided near the endless member, for causing the endless member to generate heat by an alternating current applied to flow through the electromagnetic induction coil; a current control section for controlling the current flowing through the electromagnetic induction coil; a rotation mechanism for rotating the endless member; and a rotation mechanism control section for selectively operating the rotation mechanism.

Also, the present invention provides a fixing device comprising: a first endless member which has a cylindrical or belt-like shape and includes a conductive part; a second endless member which has a cylindrical or belt-like shape, includes a conductive part, and contacts an arbitrary point in a circumferential direction of the first endless member; a coil member provided inside at least one of the first and second endless members, for generating an eddy current at the conductive part of the at least one of the endless members, the coil member making no contact with an inner surface of the at least one of the endless member; a power source circuit connected with an external power source and capable of supplying a current having a predetermined frequency to the coil member; a current control section for controlling a size of the current supplied to the coil member from the power source circuit, and electric-conduction/shut-off of the coil member; a rotation mechanism for rotating the endless members; and a rotation mechanism control section for selectively controlling the rotation mechanism.

Further, the present invention provides an image forming apparatus comprising: a photosensitive member for holding a latent image corresponding to an image to be outputted; a developing device for selectively supplying a visualizing agent to the latent image held by the photosensitive member, thereby to form a visualizing-agent image corresponding to the latent image, on the photosensitive member; a transfer device for transferring the visualizing-agent image formed by the developing device to a transfer medium from the photosensitive member; and a fixing device including a first endless member which has a cylindrical or belt-like shape and includes a conductive part, a second endless member which has a cylindrical or belt-like shape, includes a conductive part, and contacts an arbitrary point in a circumferential direction of the first endless member, a coil member provided inside at least one of the first and second endless members, for generating an eddy current at the conductive part of the at least one of the endless members, the coil member making no contact with an inner surface of the at least one of the endless member, at least two temperature detection devices provided at a predetermined interval in a rotating direction of a metal layer of the at least one of the endless members, for detecting a temperature of the electromagnetic induction coil or a temperature of the metal layer, a power source circuit connected with an external power source and capable of supplying a current having a predetermined frequency to the coil member, a current control section for controlling a size (frequency) of the current supplied to the coil member from the power source circuit, and electric-conduction/shut-off of the coil member, a rotation mechanism for rotating the endless members, and a rotation mechanism control section for selectively controlling the rotation mechanism, wherein the visualizing-agent image transferred to the transfer medium by the transfer device and the transfer medium are heated and pressed between the first and second endless members.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
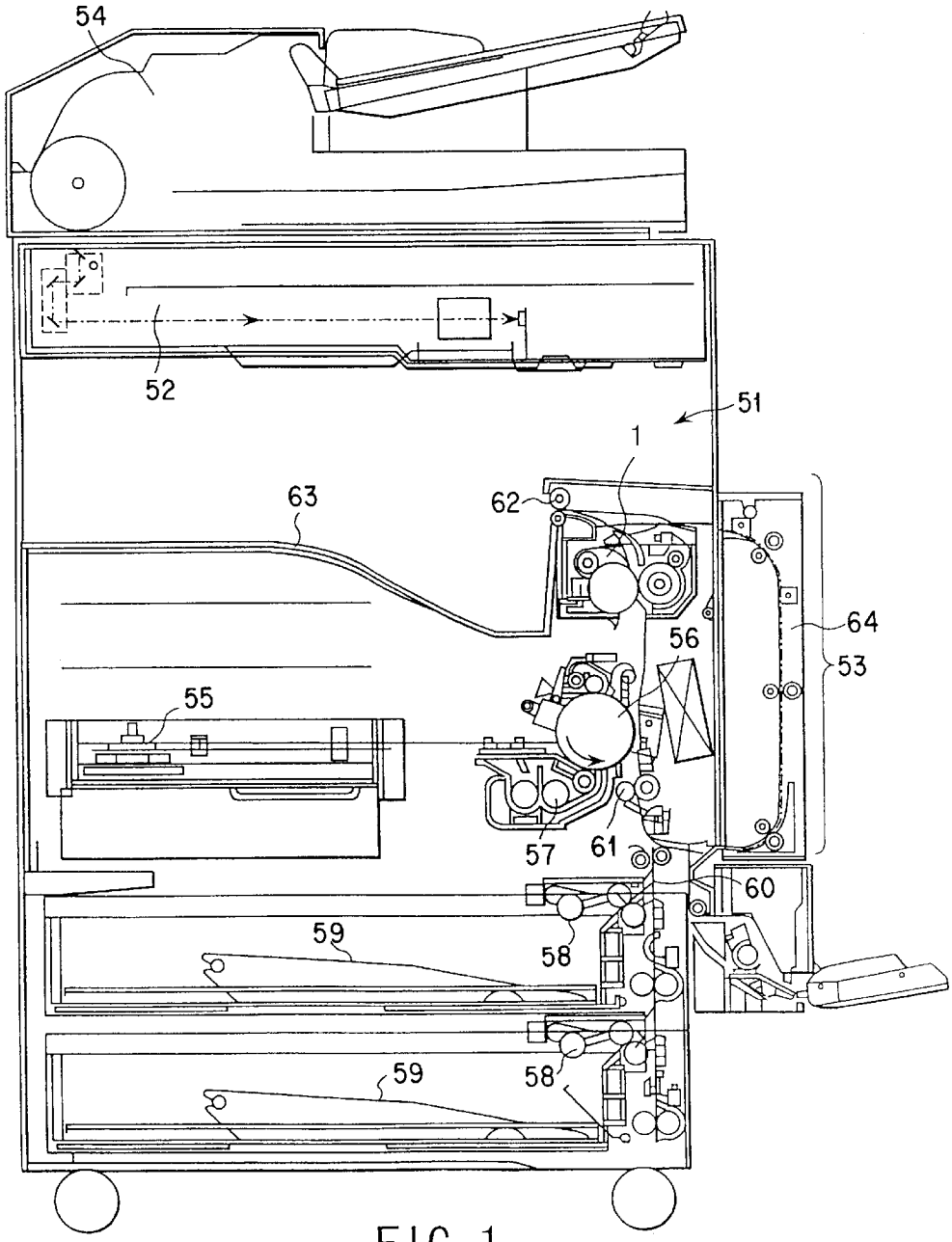
FIG. 1 is a schematic view showing a digital copying machine which incorporates a fixing device according to an embodiment of the present invention.

In the following, explanation will be made of a digital copying machine 51 as an example of an image forming apparatus according to an embodiment of the present invention, with reference to the drawings. FIG. 1 is a schematic view explaining the digital copying machine.

As shown in FIG. 1, the digital copying machine 51 includes a scanner 52 which reads image information of a copying target as brightness of light and generates an image signal, and an image forming section 53 which forms an image corresponding to an image signal supplied from the scanner 52 or from the outside. The scanner 52 is integrally provided with an automatic original feeder (ADF) which sequentially exchanges copying targets, linked with image read operation by the scanner 52, if copying targets are sheet-like materials.

The image forming section 53 has an exposure device 55, a photosensitive drum 56, a developing device 57, a fixing device 1, and the like. The exposure device 55 irradiates a laser beam corresponding to image information supplied from the scanner 52 or from the outside for example, computer. The photosensitive drum 56 holds an image corresponding to the laser beam from the exposure device 55. The developing device 57 supplies a developer to an image formed on the photosensitive drum 56 and develops the image. The fixing device 1 heats and melts the developer, to fix it to a transfer material, in a state that a developer image on the photosensitive drum 56, which has been developed by the developing device 57, is transferred to a sheet conveyance section explained later.

When image information is supplied from the scanner 52 or the outside, a laser beam whose intensity is modulated in accordance with image information is irradiated on the photosensitive drum 56 previously charged to a predetermined potential.

In this manner, an electrostatic latent image corresponding to the image to be copied is formed on the photosensitive drum 56.

The electrostatic latent image formed on the photosensitive drum 56 is supplied with toner selectively by the developing device 57, so it is developed. The electrostatic latent image is then transferred to a paper P as a transfer material supplied from a cassette which will be explained later.

The paper P to which the toner T has thus been transferred is conveyed to the fixing device 1. The toner T is melted and fixed by the fixing device 1.

Papers P are picked up one after another from a paper cassette 59 provided below the photosensitive drum 56, and pass through a conveyance path 60 toward the photosensitive drum 56. Each paper is conveyed to an aligning roller 61 for aligning the position of the paper with the toner image (developer image) formed on the photosensitive drum 56 and is then fed at a predetermined timing to a transfer position where the photosensitive drum 56 and the transfer device face each other.

Meanwhile, a paper P to which an image has been fixed by the toner T is fed out by a paper feed-out roller 62 onto a feed-out space (feed-out tray) 63 provided between the scanner 52 and the cassette 59. If necessary a double-side paper feed device 64 which inverts the paper P having an image fixed on one surface is provided between the fixing device 1 and the cassette 59.

Next, the fixing device 1 will be explained in more details below.

Figure 2:
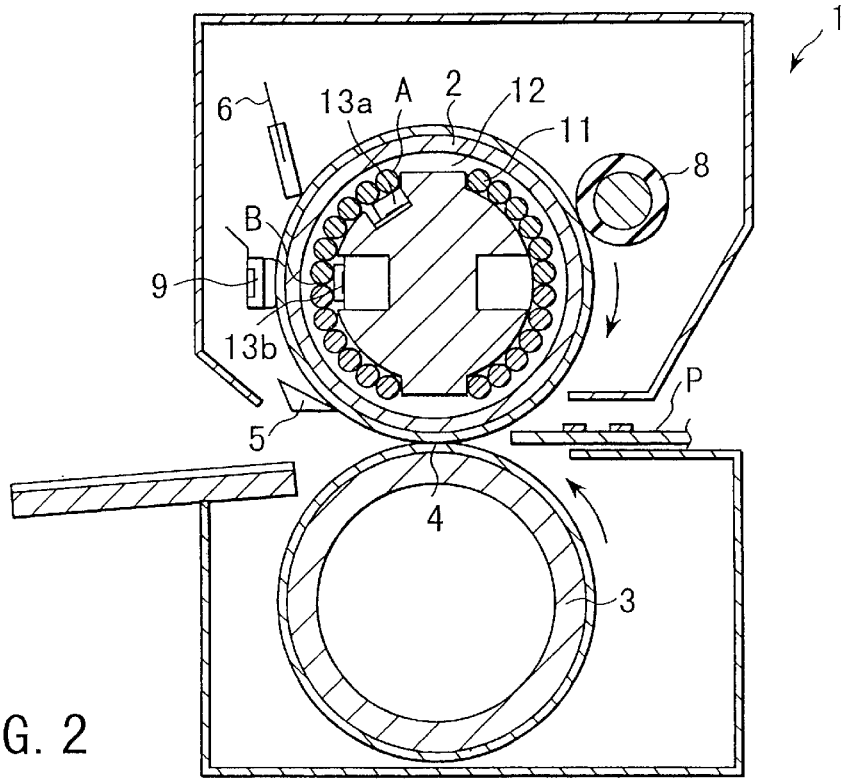
FIG. 2 is a schematic view showing the entire fixing device of the copying machine shown in FIG. 1.

FIG. 2 is a schematic cross-sectional view showing a first embodiment of the fixing device. Also, FIG. 3 is a schematic perspective view which explains the shape of a coil incorporated in the fixing device shown in FIG. 2.

Figure 3:
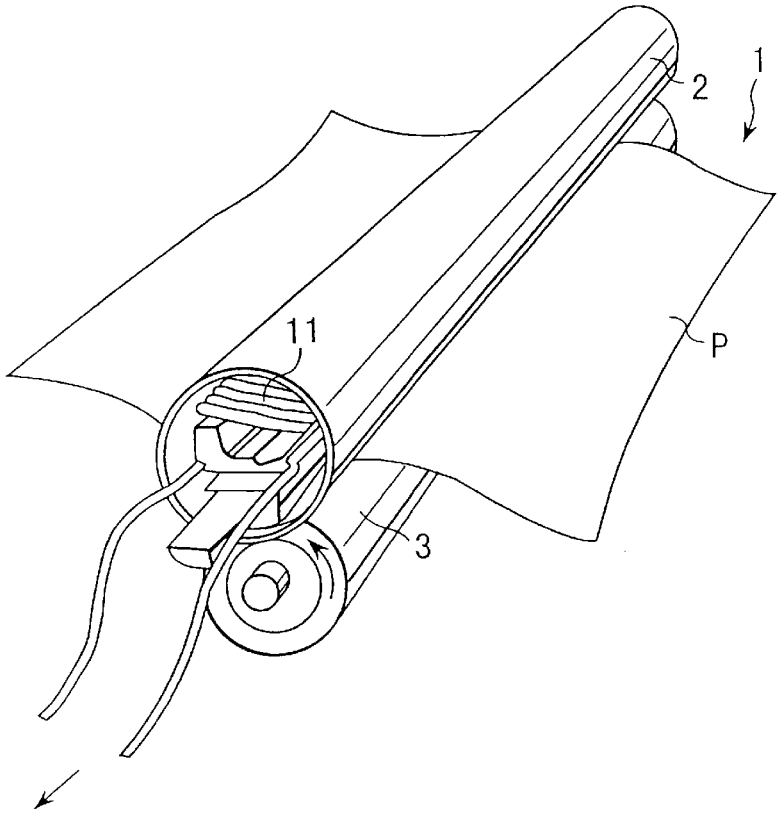
FIG. 3 is a perspective view simply showing a heating roller and a magnetic-field generation mechanism in the fixing device shown in FIG. 2.

As shown in FIGS. 2 and 3, the fixing device 1 is constructed by a heating (fixing) roller 2 and a press roller 3. Each of these rollers has an outer diameter of 40 mm, for example.

The heating roller 2 is driven in an arrow direction by a drive motor not shown. The press roller 3 rotates in another arrow direction, slaved to the heating roller. A paper P as a fixing-target material supporting a toner image is let pass between the rollers.

For example, the heating roller 2 is an iron-made cylinder having a wall thickness of 1 mm, i.e., an endless member having a metal layer formed of a conductive material. A mould-releasing layer made of Teflon (trade name) or the like is formed on its surface. Stainless steel, aluminum, alloy of stainless steel and aluminum, or the like can be used for the heating roller 2.

In the press roller 3, an elastic material such as silicon rubber or fluoro-rubber is covered around a metal core 3*a*. The press roller 3 is pressed into contact with the heating roller 2 at a predetermined pressure by a press mechanism not shown, so that a nip (where the outer circumferential surface of the press roller 3 is elastically deformed due to the press contact) of a predetermined width is created at the position where both rollers contact each other.

Accordingly, as a paper P passes through the nip, the toner on the paper P is melted and fixed to the paper P.

A peeler 5, a cleaning member 6, a mould-releasing agent applicator 8, and a thermistor 9 are provided in the downstream side of the nip 4 in the rotation direction on the circumference of the heating roller 2. The peeler 5 peels the paper P from the heating roller 3. The cleaning member 6 removes toner offset-transferred onto the outer circumferential surface of the heating roller 2 and paper dusts from papers. The mould-releasing agent applicator 8 applies a mould-releasing agent to prevent toner from sticking to the outer circumferential surface of the heating roller 2. The thermistor 9 detects the temperature of the outer circumferential surface of the heating roller 2.

Inside the heating roller 2, an exciting coil 11 is provided as a magnetic-field generation means made of a litz wire constructed by bundling a plurality of copper wires which are insulated from each other.

Since the exciting coil is made of a litz wire, the wire diameter can be set to be smaller than the permeation depth, so that an alternating current can flow effectively. In the first embodiment, bundled sixteen wires each having a diameter of 0.5 mm and covered with heat-proof polyamide-imide are used as the exiting coil 11. Also, the exciting coil 11 is an air-core coil which does not have a core member (e.g., ferrite-made or iron-made core). By thus forming the exciting coil 11 as an air-core coil, a core member having a complicated shape is not required, and therefore, costs are reduced. In addition, the exciting circuit is at a low price.

The exciting coil 11 is supported by a coil support member 12 formed of heat-proof resins (e.g., high heat-proof industrial plastics).

The coil support member 12 is positioned between the exciting coil 11 and a structure member (a sheet metal) not shown which holds the heating roller.

The exciting coil 11 generates magnetic flux and an eddy current at the heating roller 2 so that changes of the magnetic field can be prevented by magnetic flux generated by a high-frequency current from an exciting circuit (inverter circuit) not shown. Joule heat is generated by the eddy current and a resistance specific to the heating roller 2, so the heating roller 2 is heated. In the present embodiment, a high-frequency frequency current of 900 W at a frequency of 25 kHz is let flow through the exciting coil 11.

Figure 4:
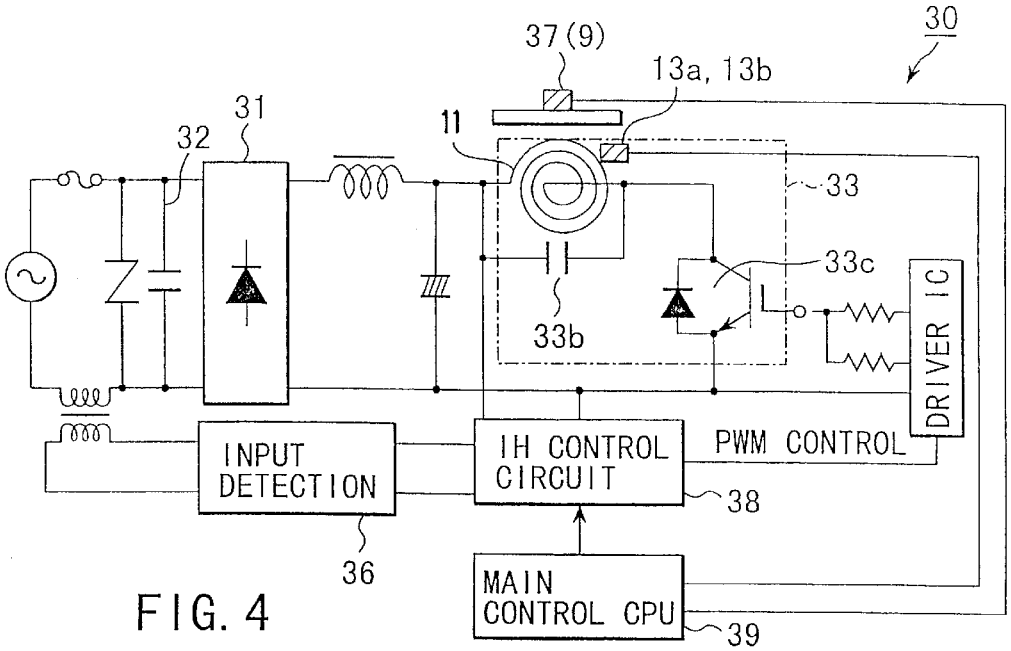
FIG. 4 is a schematic view which explains a drive circuit (semi-E class type inverter circuit) for driving an induction heating coil in the fixing device shown in FIG. 2.

FIG. 4 is a block diagram showing a control system, i.e., a drive circuit of the fixing device as the first embodiment shown in FIGS. 2 and 3.

In the drive circuit 30, a high-frequency current is supplied to the exciting coil 11, by an inverter circuit 33 in electrical communication with coil 11, a resonance capacitor 33*b*, and a switching circuit 33*c* and which rectifies an alternating current from a commercial power source by means of a rectifying circuit 31 and a smoothing capacitor 32. Like a drive circuit which will be explained later with reference to FIGS. 21A, 21B, 21C, and 22, a heat sink 761 may be attached to an IGBT (Insulating Gate Bipolar Transistor) 760 as a switching element and may be cooled by a fan 881. The fan 881 drives in synchronization with start of conductance to the exciting coil 11. That is, the fan 881 is rotated at least while a high-frequency current is supplied to the exciting coil 11 under control by the main control CPU 39 or an IH (Induction Heating) control circuit 38. According to this structure, the fan 881 makes the least necessary operation, so that the IGBT 760 can be cooled effectively without undesirably increasing the power consumption. Note that the cooling fan 881 may be rotated for an appropriate time period at an appropriate timing, based on the temperature obtained by measuring the temperature of the IGBT 760 by means of the thermistor 762. In this case, the fan 881 is driven only when the temperature of the IGBT 760 reaches a permissible temperature. Therefore, the power consumption of the entire copying machine can further be reduced. In addition, both of stable switching and fine control can be achieved together.

The high-frequency current is detected by an input detection means 36 and is controlled to a specified output value. The specified output value can be controlled by changing the ON-time of a switching element 33*c* at an arbitrary timing, for example, by PWM (Pulse Width Modulation) control. At this time, the drive frequency changes.

Information from the temperature detection means (which correspond to two temperature sensors 13*a* and 13*b* provided at two position of an exemplified coil 11 explained below and the thermistor 9) 37 for detecting the temperature of the exciting coil 11 and the temperature of the heating roller 2 is inputted to the main control CPU 39 and is inputted to an IH circuit 38 by an ON/OFF signal from the CPU 39. It is also possible to control directly the IH circuit 38 by means of an output from the temperature detection means 37.

In FIG. 2, the surface temperature of the heating roller 2 is controlled to, for example, 180° C. by temperature detection by the thermistor 9 and feedback control concerning the detection results.

A condition necessary for fixing toner to a paper is that the temperature of the heating roller 2 should be uniform on the entire area in the circumferential direction of the heating roller 2. When the heating roller 2 stops its rotation, generation of magnetic flux functions with different strengths in the circumferential direction due to the characteristic of the exciting coil 11 as an air-core coil shown in FIG. 2, so that the temperature distribution is uneven. Consequently, unevenness of the temperature of the roller 2 in the circumferential direction thereof must be eliminated immediately before a paper P passes through the nip 4.

Therefore, rotation of the heating roller 2 is stopped for a constant time period to increase efficiently the temperature of the heating controller 2, immediately after starting electric conductance of the exciting coil 11. However, the heating roller 2 and the press roller 3 are rotated to make the temperature distribution uniform on the entire roller, after elapse of a predetermined time.

By rotating the heating roller 2 and the press roller 3, a constant quantity of heat is supplied to the entire surfaces of both rollers.

When the surface temperature of the heating roller 2 reaches 180° C., copying operation is enabled so that a toner image is formed on the paper P at a predetermined timing.

The toner on the paper P is fixed thereto as it passes through a transfer contact portion constructed by the heating roller 2 and the press roller 3, i.e., the nip 4.

Two temperature sensors 13*a* and 13*b* for detecting the temperature of the exciting coil 11 are provided inside the exciting coil 11 supported on the coil support member 12. The first temperature sensor 13*a* is provided at a position on the exciting coil 11, which is close to an opening portion (an end portion in the lengthwise direction) of the heating roller 2 and also to an end portion in the circumferential direction. The second temperature sensor 13*b* is provided at a position (close to the center in the circumferential direction) which forms substantially an angle of 80 to 90° with respect to the first sensor 13*a* (as specifically shown in FIG. 5).

Thus, the two temperature sensors 13*a* and 13*b* are provided at positions spaced apart from each other inside the exciting coil 11. In this mariner, induction heating drive circuit shown in FIG. 4 can be controlled so that the temperature of the exciting coil 11 might not exceed the heat-proof temperature of the coatings of the wires forming the coil 11.

Needless to say, the surface temperature of the heating roller 2 can be detected by the thermistor 9. However, the temperature of the exciting coil 11 cannot be grasped, so there is a case that the temperature exceeds the heat-proof temperature of the coil 11 and is thereby damaged when passing papers sequentially. In the present embodiment, this problem can be solved since the coil temperature is detected.

The temperature sensors 13*a* and 13*b* are advantageous for eliminating influences from a difference from the temperature distribution on the outer surface of the heating roller 2, which is caused due to the characteristic of the exciting coil 11 when the heating roller 2 and the press roller 3 stop.

More specifically, an eddy current is generated at a place where the heating roller 2 and the exciting coil 11 face each other, by the generation mechanism of the eddy current in the heating roller 2. Therefore, the heat quantity of a portion of the heating roller 2 that corresponding to a center part B of the exciting coil 11 becomes greater than the heat quantity of another portion of the heating roller 2 that corresponds to an opening part A of the exciting coil 11.

As a result of this, the temperature increase on the outer surface of the roller 2 is large near the center and small near the opening part A, when the heating roller 2 is not rotated. Also, the temperature increase is caused due to radiation heat from the heating roller 2 and copper loss of the coil 11 itself.

Therefore, the temperature sensor 13*b* attached to the center part B of the exciting coil 11 can grasp both of the temperature increase due to radiation from the heating roller 2 and the copper loss of the exciting coil 11 itself, by providing the temperature sensors 13*a* and 13*b* at positions undergoing independent different conditions.

Meanwhile, the temperature sensor 13*a* attached to the opening part A (where the heating roller 2 itself does not generate heat) of the exciting coil 11 receives less influences from radiation from the heating roller 2 and can therefore grasp influences due to copper loss of the exciting coil 11.

Accordingly, the heat-proof temperature of the exciting coil is mainly grasped by the temperature sensor 13*b* attached to the part B, while influences from copper loss of the exciting coil 11 is grasped by the temperature sensor 13*a* attached to the part A. If heat generation due to copper loss of the exciting coil 11 increases extremely, it can be determined that any abnormality occurs at the exciting coil 11. In this case, a countermeasure can be taken by restricting the current amount supplied to the exciting coil 11 from the driving circuit.

Figure 5:
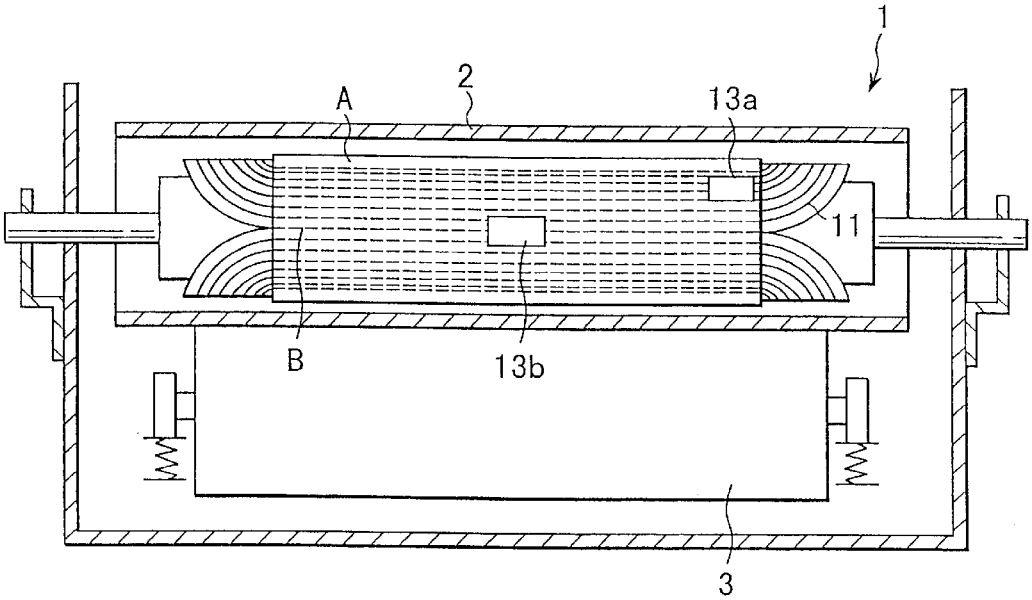
FIG. 5 is a schematic cross-sectional view which explains the structure of the fixing device shown in FIG. 2, in its lengthwise direction.

As shown in FIGS. 2 and 5, two temperature sensors 13*a* and 13*b* are provided respectively at an end part and a center part of the exciting coil in its lengthwise direction, as well as at an end part and a center part of the exciting coil 11 in its circumferential direction. As a result of this, it is possible to measure the temperature distribution of the exciting coil 11 in the lengthwise direction of the heating roller 2 when the heating roller 2 rotates, i.e., when a paper is let pass there.

For example, when sequentially passing papers, a difference appears in the surface temperature of the heating roller 2 between a paper-passing area and a non-paper passing area of the paper. That is, the difference appears more clearly between the case where the conveyance direction is set to the direction perpendicular to the shorter edges of a paper of A4 size (A4 longitudinal position) and the case of a postcard or the like. At this time, since the heating roller 2 rotates, unevenness of the temperature is eliminated.

Under this condition, the temperature sensor 13*a* provided at an end portion of the exciting coil 11 can be used to grasp whether or not the temperature at the end portion of the heating roller 2 suddenly increases and exceeds the heat-proof temperature of the exciting coil 11. Before the temperature exceeds the heat-proof temperature, the drive circuit can be turned off. Although the temperature sensors 13*a* and 13*b* use a thermocouple in the present embodiment, a thermistor may be used in place of it.

Thus, according to the present embodiment, it is possible to grasp temperature changes of the exciting coil 11 in the circumferential direction while the heating roller 2 stops, and also to grasp temperature, changes of the exciting coil 11 in the lengthwise direction of the heating roller 2 while the heating roller 2 rotates. Thus, temperature detections of two types can be realized by two sensors when the heating roller 2 stops and when it rotates. As a result of this, it is possible to prevent the temperature of the exciting coil 11 from exceeding the heat-proof temperature and from being thereby damaged. Accordingly, the lifetime of the exciting coil 11 can be improved.

Figure 6:
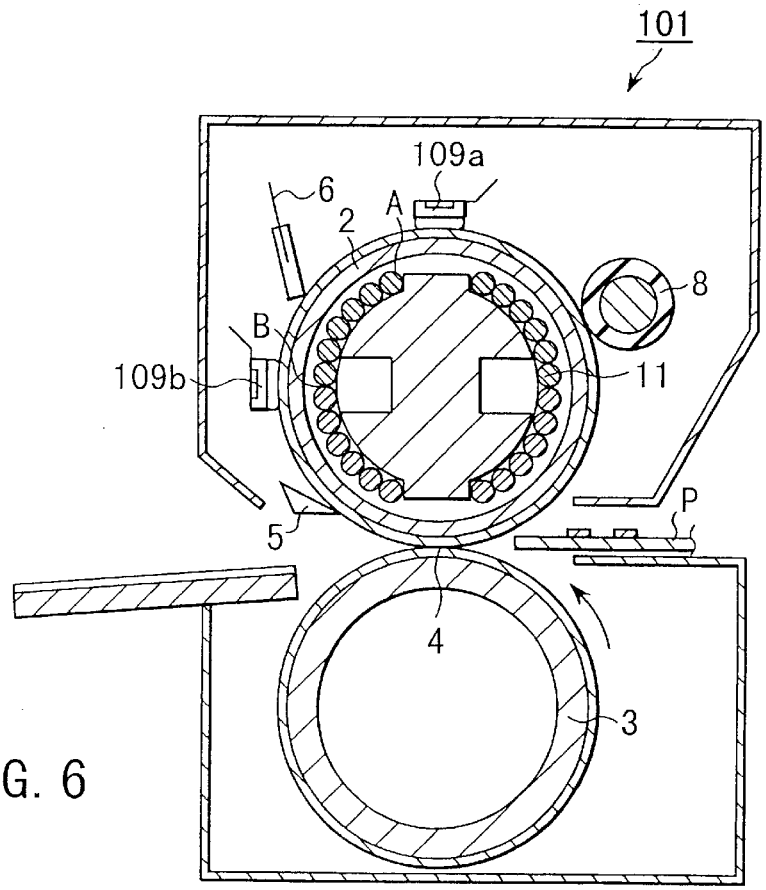
FIG. 6 is a schematic view showing another embodiment of the fixing device shown in FIG. 2.

FIG. 6 is a schematic cross-sectional view which illustrates a fixing device according to another embodiment of the present invention. The same structural component as those of the fixing device of the first embodiment will be denoted at the same reference symbols as those of the first embodiment which has been explained with reference to FIG. 2, FIG. 3, and FIG. 5. Detailed explanation of those components will be omitted herefrom. In addition, the same circuit as shown in FIG. 4 is used as the control system.

As shown in FIG. 6, in a fixing device 101, two thermistors 109*a* and 109*b* are provided at an angular interval (90°) maintained therebetween. The two thermistors 109*a* and 109*b* are provided respectively at a center part and an end part of the heating roller 2 in its lengthwise direction.

By thus providing at least two thermistors shifted from each other on the outer circumferential surface of the heating roller 2, advantages can be obtained from the characteristic of the exciting coil 11, in removal of differences in temperature distribution on the surface of the heating roller 2, for example, when each of the heating roller 2 and the press roller 3 is stopped.

More specifically, the generation mechanism of the eddy current in the heating roller 2 generates an eddy current at a place where the exciting coil 11 faces the heating roller 2. Therefore, heat generation of the part of the heating roller 2 corresponding to the center part B of the coil 11 is greater than the heat generation of the part of the heating roller 2 corresponding to the center part B of the coil 11.

Accordingly, the temperature increase on the outer surface of the heating roller 2 is large near B and is small near A if the heating roller 2 is not rotated. Unevenness of the temperature on the outer circumferential surface in the circumferential direction thereof is eliminated by rotating both of the heating roller 2 and the press roller 3.

However, the rotation of both the heating roller 2 and the press roller 3 just means that the temperature of the heating roller 2 being heated escapes to the press roller 3. For example, for a constant time immediately after electrically conducting a copying machine, the heating roller 2 and the press roller 3 are generally controlled so as not to rotate. That is, extension of the warm-up time can be restricted by preventing the heating roller 2 and the press roller 3 from being rotated for the constant time immediately after electric conduction.

Meanwhile, if both of the rollers 2 and 3 are not rotated, a temperature difference appears on the outer surface of the heating roller 2 in its circumferential direction. Therefore, the temperature difference on the outer circumferential surface of the heating roller 2 can be accurately grasped by the first and second thermistors 109*a* and 109*b* provided with their phases shifted by 90° from each other. Since the two thermistors 109*a* and 109*b* grasp the maximum and minimum temperatures on the outer surface of the heating roller 2 in the circumferential direction, control can be performed such that both the rollers 2 and 3 are rotated when the difference between the maximum and minimum temperatures exceeds a constant temperature.

Meanwhile, two thermistors 109*a* and 109*b* need only be attached to a center part of the heating roller 2 in its lengthwise direction, in case of merely determining a difference between temperature distributions on the outer surface of the heating roller 2 as described above. However, by providing one of the thermistors at an end part of the roller 2 as shown in FIG. 6, it is possible to measure the temperature distribution of the exciting coil 11 in the lengthwise direction of the roller 2 when the heating roller 2 is rotated, i.e., when a paper is let pass.

This means that a desirable increase of the temperature at the end part of the heating roller 2 can be detected by means of the thermistor 109*a* provided at the end part of the heating roller 2, due to a difference of the surface temperature on the outer circumferential surface of the heating roller 2 between a paper-passing area and a nonpaper-passing area. By way of example but not by way of limitation, this difference appears if an A4 -size paper (longitudinally positioned) and a postcard are used when sequentially passing papers.

In this manner, a temperature increase at an end part of the heating roller 2 with respect to a center part thereof is grasped, and control can therefore be performed so as to prevent the temperature of the end part of the roller 2 from increasing abnormally.

Figure 8:
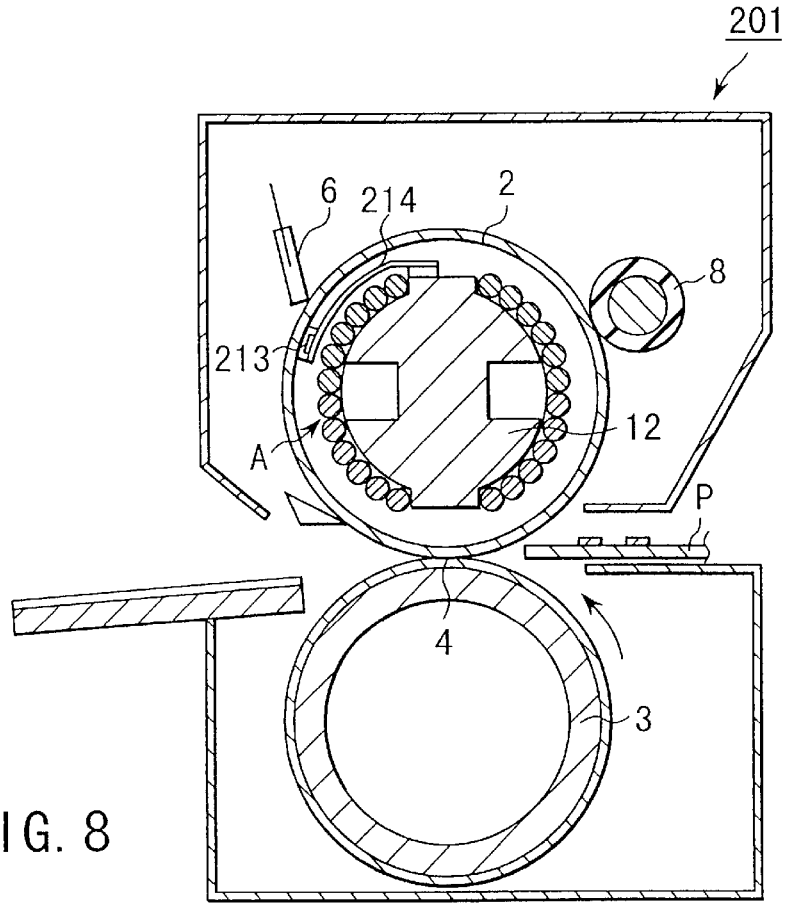
FIG. 8 is a schematic view showing another embodiment of the fixing device shown in FIG. 2.

FIG. 8 is a schematic view illustrating further another embodiment of the present invention. The same structural components as those in FIGS. 2, 3, and 5 will be denoted at the same reference symbols as shown in these figures. Detailed explanation thereof will be omitted herefrom.

As shown in FIG. 8, in the fixing device 201, a temperature sensor 213 for measuring the surface temperature of the heating roller 2 is provided at a position inside the metal layer of the heating roller 2 and outside the exciting coil 11. The temperature sensor 213 is not positioned at an opening part of the exciting coil 11 but is provided at a position facing the center part A of the exciting coil 11 (at the position substantially shifted by 90° from the opening part of the exciting coil 11).

More specifically, the temperature sensor 213 is supported by a sensor support member 214 made of resins and extended from the opening end side of the coil support member 12 holding the exciting coil 11. The temperature sensor 213 held by the support member 214 contacts the inner surface of the metal layer of the heating roller 2. Although the present embodiment uses a thermistor as the temperature sensor 213, it may be a thermocouple, a thermostat, or an infrared temperature sensor, for example.

Thus, the temperature sensor 213 for measuring the roller temperature of the heating roller 2 is provided, kept in contact with the metal layer on the inner circumference of the roller 2. Therefore, in the present method in which an eddy current is generated from the roller 2 by induction heating thereby to achieve heating, heat is transmitted through the metal layer of the roller 2, so that it is possible to remove influences from a time lag caused when measuring the temperature on the outer surface of the roller 2.

That is, Joule heat generated by an eddy current caused at an inner surface part of the metal layer of the heating roller 2 gradually decreases from the surface of the metal layer toward the inside thereof (e.g., from the inside of the metal layer of the roller 2 toward the outer surface thereof). This can be calculated from the surface depth (the thickness of the metal layer). In general, it is confirmed that the depth to which the metal layer of the heating roller 2 is heated by the Joule heat is about 0.1 mm or less. Accordingly, a time lag occurs until heat is transmitted to the outer surface of the metal layer of the heating roller 2, so that the response speed is low if temperature detection is carried out outside the roller. In some cases, it is impossible to respond to a sudden sharp temperature increase, and over-shooting occurs. In addition, it is confirmed that the response may be more delayed due to the influence from the response speed of the sensor itself.

In this respect, by providing the temperature sensor 213 inside the metal layer of the heating roller 2, the temperature of the outer surface of the heating roller 2 can be detected at a high speed. Accordingly, the temperature of the outer surface of the heating roller 2 can be detected with high response ability even if a temperature difference appears in the circumferential direction of the heating roller 2 while the heating roller 2 is not rotated.

As a result, the temperature of the outer surface of the heating roller 2 can be controlled accurately at a high speed. If the temperature sensor is provided on the outer surface of the heating roller 2 as shown in FIG. 2 and if the temperature sensor is of a contact type, the surface layer of the heating roller 2 may be deteriorated at a contacting part. However, this risk need not be considered in case of the structure shown in FIG. 8. In addition, in case of a conventional halogen heater, it is substantially difficult to provide the temperature sensor 213 on the inner surface of the metal layer of the heating roller 2 because a space for installation of a temperature sensor cannot be obtained and because the halogen lamp has a high temperature. The temperature sensor 213 can be provided, for the first time, on the inner surface of the metal layer of the heating roller 2, by adopting an air-core coil having an opening part as the exciting coil 11.

Figure 9:
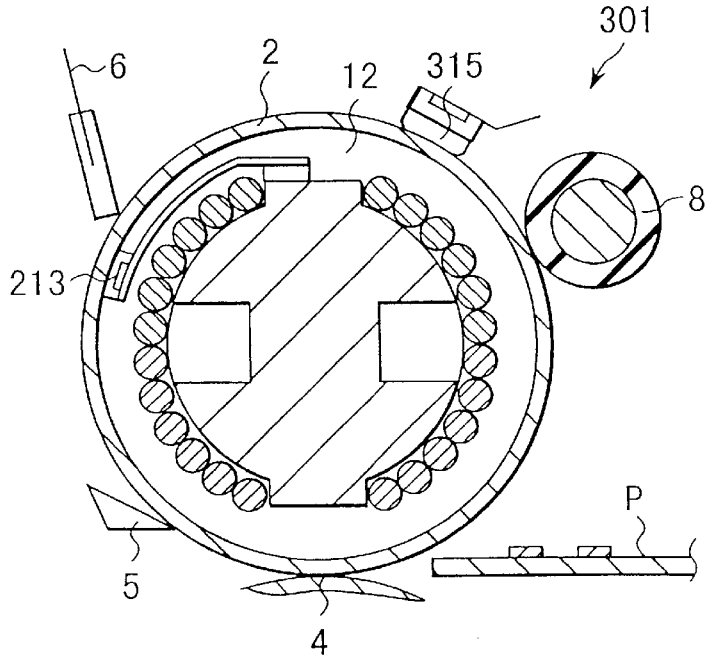
FIG. 9 is a schematic cross-sectional view of the fixing device shown in FIG. 8.

As shown in FIG. 9, another temperature sensor 315 may be provided on the outer surface of the metal layer of the heating roller 2, in addition to the temperature sensor 213 shown in FIG. 8.

The fixing device 301 shown in FIG. 9 is constructed by adding the temperature sensor 315 of a contact type which detects the temperature of the outer surface of the heating roller 2, to the fixing device 201 shown in FIG. 8. According to this structure, the temperature of the outer surface of the heating roller 2 is controlled by the temperature sensor 213 inside the heating roller 2, immediately after a drive current is supplied to the exciting coil 11, i.e., during the starting operation of the fixing device. When sequentially passing papers, the temperature of the outer surface of the heating roller 2 can be controlled by the temperature sensor 315 outside the heating roller 2.

According to this method, the temperature sensor 213 inside the heating roller 2 is effective mainly for monitoring of the temperature increase of the exciting coil 11. When the outer surface of the heating roller 2 becomes higher than the temperature of the exciting coil 11 by a constant value or more, the drive current from the induction heating drive circuit can be stopped so that the temperature of the exciting coil 11 can be reduced to a heat-proof temperature of the coil 11 or less.

Figure 10:
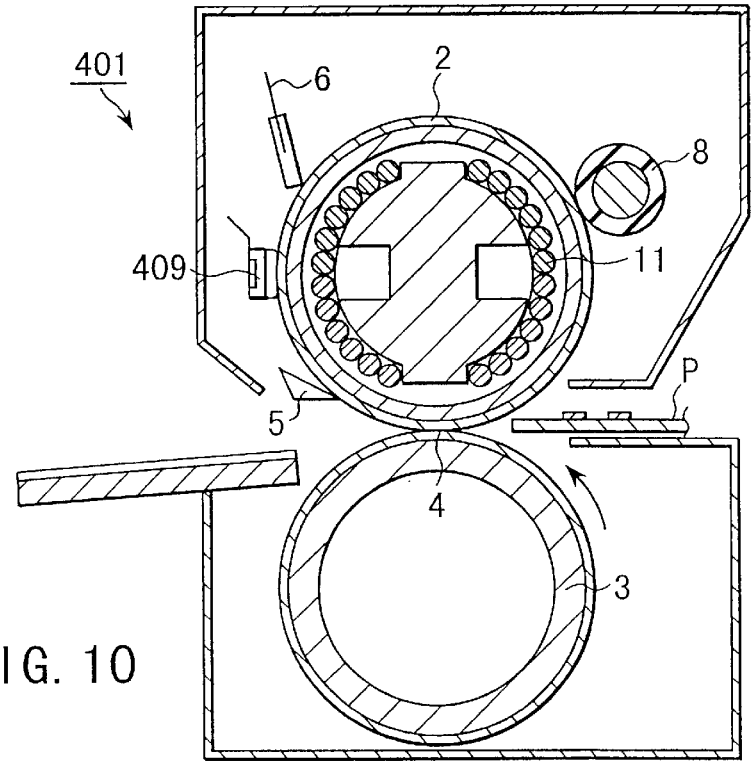
FIG. 10 is a schematic view showing further another embodiment of the fixing device shown in FIG. 2.

FIG. 10 is a schematic cross-sectional view illustrating a fixing device according to further another embodiment of the present invention. The same structural components as those of the fixing device according to the first embodiment explained with reference to FIGS. 2, 3, and 5 will be denoted at the same reference symbols as those of the first embodiment. Detailed explanation of those components will be omitted herefrom. The circuit shown in FIG. 4 is used as the control system.

As shown in FIG. 10, in the fixing device 401, a temperature sensor 409 for detecting the temperature of the outer circumferential surface of the heating roller 2 is provided near the outer circumferential surface of the roller where the temperature increases most due to heating by the exciting coil 11 in the roller 2.

Figure 11:
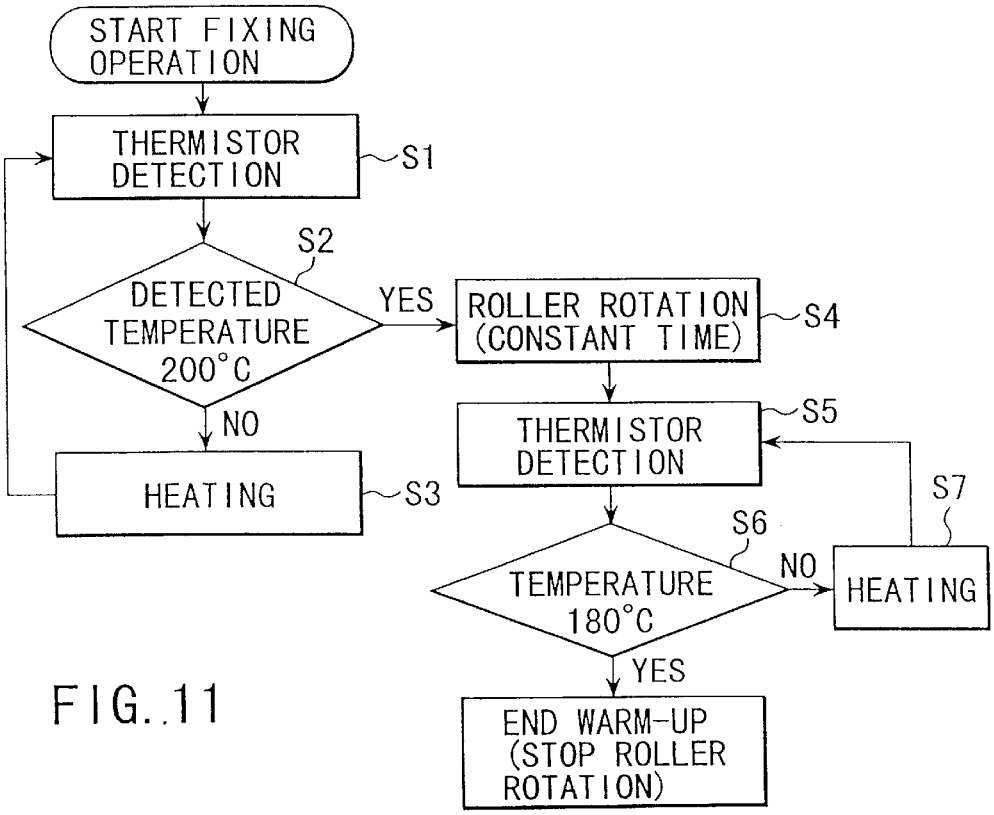
FIG. 11 is a flowchart which explains operation of the fixing device shown in FIG. 10.

In the fixing device shown in FIG. 10, control is carried out as follows in the starting period. As shown in the flowchart of FIG. 11, the extent to which the exciting coil 11 is heated by the high-frequency current from the drive circuit is detected by the thermistor (temperature sensor) 409 (S1). Heating is continued (S3) until the detected temperature reaches a temperature (e.g., 200° C.) which is higher by a predetermined temperature than 180° C. as a roller temperature during normal use (S2). At the time point when the roller temperature reaches 200° C. (S2-YES), the heating roller 2 is rotated. That is, the heating roller 2 is not rotated but is only heated (S3) during a predetermined time period (until the temperature of the roller 2 reaches 200° C.) after a drive current is supplied to the exciting coil 11.

If the roller 2 is rotated at the time point when the temperature of the surface of the heating roller 2 reaches 200° C. (S4), the heat is absorbed by the press roller 3 so that the temperature of the outer surface of the heating roller 2 rapidly decreases to 120° C. or so. Then, the temperature sensor 409 monitors again the temperature of the outer surface of the roller 2 (S5). Until the temperature of the outer surface of the heating roller 2 reaches to 180° C. (S6), a drive current is supplied to the exciting coil 11 to heat the heating roller 2 (S7).

Thus, until the temperature sensor 409 detects 180° C. as the temperature of the outer surface of the heating roller 2 (S6-YES), the exciting coil 11 is supplied with a predetermined current and the heating roller 2 is thereby heated (S7).

Thus, the heating roller 2 is not rotated but is only heated until the temperature sensor 409 in contact with the outer surface of the roller 2 detects a temperature higher by about 20° C. than the roller surface control temperature during operation (i.e., until the time when the temperature reaches 200° C. in this embodiment in which the roller is controlled to 180° C. during rotation), when heating the outer surface of the heating roller 2. As a result, the heating time (warm-up time) can be reduced.

That is, when the outer surface of the heating roller 2 is heated as shown in FIG. 11, the heating time is reduced by not rotating but heating the heating roller 2 until the temperature sensor 409 contacting the outer surface of the heating roller 2 detects a temperature which is higher by a predetermined temperature difference than the roller surface control temperature during operation. After starting rotation of the heating roller 2, the temperature sensor of the outer circumferential surface of the heating roller 2 becomes substantially uniform in several seconds. Thereafter, control need only be performed such that the outer surface of the heating roller 2 has a temperature of 180° C.

Since an air-core coil having an opening part is thus adopted as the exciting coil 11, the temperature of the roller 2 is not uniform in the circumferential direction of the roller 2 unless the heating roller 2 is rotated. However, the temperature sensor 409 is provided at a position on the outer surface of the roller 2 where the temperature becomes the highest, sag and the roller is heated to a higher temperature than the operation temperature without being rotated. Therefore, the following problem can be prevented. That is, the temperature of the outer surface of the roller reaches the operation temperature at the position of the temperature sensor 409, even though the temperature at another position, e.g., the surface temperature at the part of the roller 2 that faces the coil opening part is about 130° C., for example. In this case, when the roller 2 is rotated and the temperature of the outer surface is rendered uniform by the rotation, the surface temperature of the roller 2 is uniformed at, for example, 160° C. and the press roller 3 thereafter rotates in contact with the roller 2 thereby absorbing the heat of the roller 2. Consequently, a problem arises in that the time required until the temperature of the outer surface of the heating roller 2 reaches the operation temperature is extended.

Owing to this method, at the time point when rotation of both the rollers 2 and 3 are rotated, the temperature of the outer surface of the heating roller 2 is rendered uniform so that the temperature of the heating roller 2 becomes about 180° C. Thus, the time required for warm-up is reduced by about 15 seconds.

Figure 12:
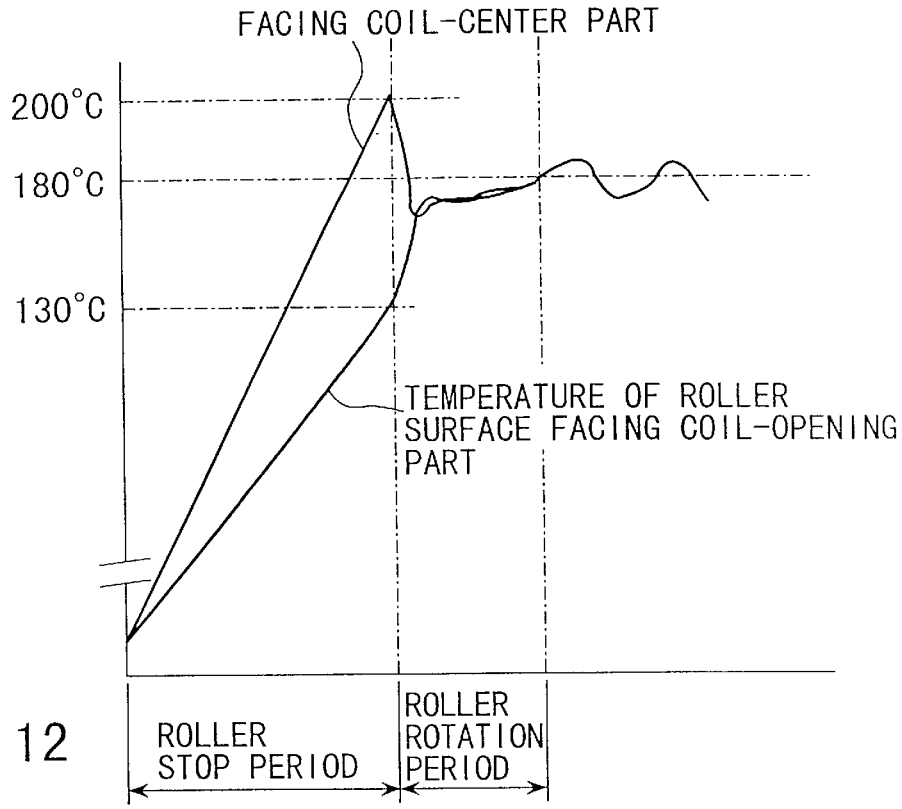
FIG. 12 is a graph showing temperature increases of the fixing roller during a warm-up period of the fixing device shown in FIG. 10.

FIG. 12 is a graph explaining a relationship between the temperature of each part of the heating 2, roller 2 and the heating time in case where the fixing device 401 shown in FIG. 10 is heated by the heating control shown in FIG. 11. The temperature sensor 409 is positioned so as to face the center part (where the temperature increases most) of the exciting coil 11. When the heating roller 2 is rotated to make the temperature of the outer surface of the roller 2 uniform, it is found that a surface temperature of 180° C. is substantially obtained at the time point when rotation of the roller 2 is started, by heating the heating roller 2 to 200° C. which is higher than 180° C. as the normal operation temperature during a heating period.

Figure 13:
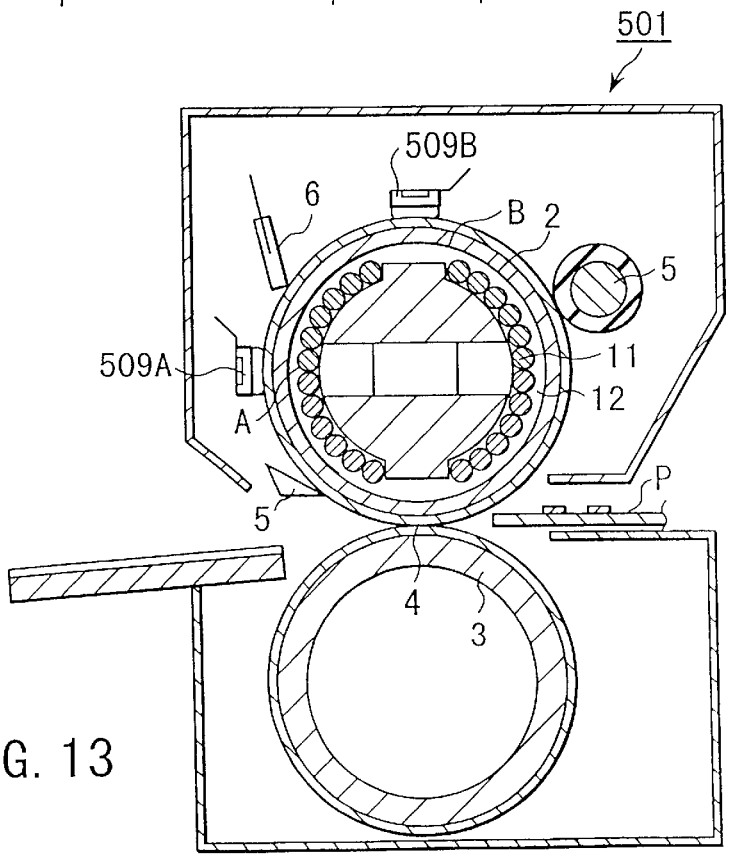
FIG. 13 is a schematic view showing further another embodiment of the fixing device shown in FIG. 2.

FIG. 13 is a schematic cross-sectional view illustrating further another embodiment of the present invention. The same structural components as those of another embodiment explained with reference to FIGS. 2 and 6 will be denoted at the same reference symbols as shown in these figures. Detailed explanation thereof will be omitted herefrom.

Figure 7:
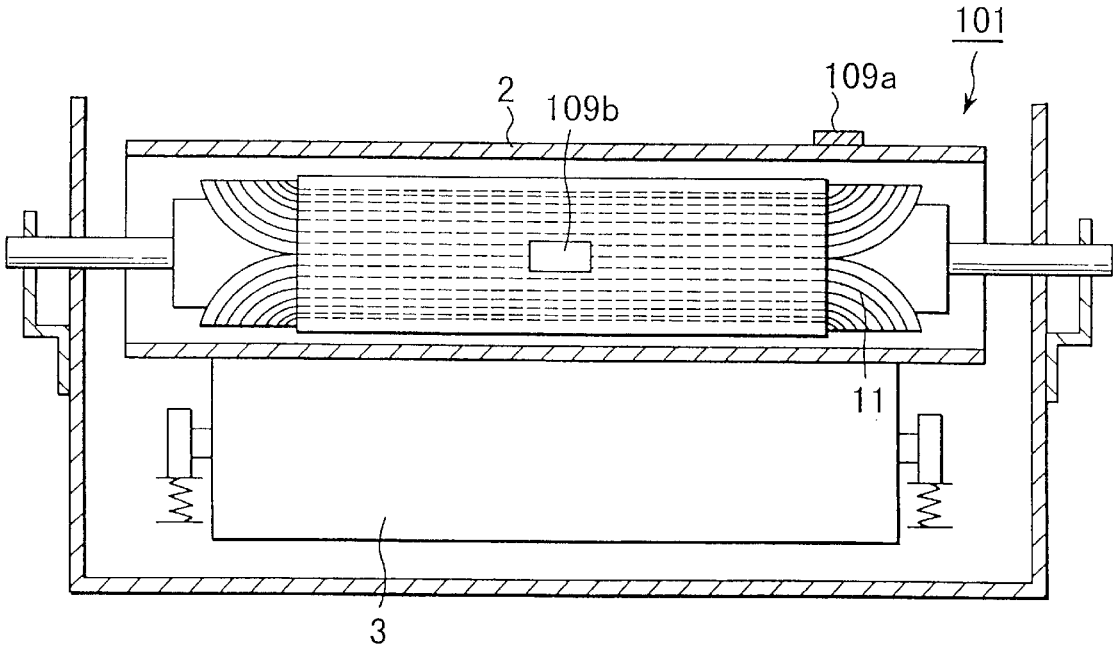
FIG. 7 is a schematic cross-sectional view which explains the structure of the fixing device shown in FIG. 6, in its lengthwise direction.

As shown in FIG. 13, in the fixing device 501, two thermistors 509*a* and 509*b* are provided at an angular interval (e.g., 90°) maintained therebetween, on the surface of the heating roller 2. The two thermistors 509*a* and 509*b* are provided respectively at a center part and an end part of the heating roller 2 in its lengthwise direction, like the thermistors 109*a* and 109*b* explained with reference to FIG. 7.

By thus providing at least two thirmistors shifted by 90° from each other in the circumferential direction on the outer circumferential surface of the heating roller 2, advantages can be obtained from the characteristic of the exciting coil 11, in removal of differences in temperature distribution on the surface of the heating roller 2, for example, when each of the heating roller 2 and the press roller 3 is stopped.

More specifically, the generation mechanism of the eddy current in the heating roller 2 generates an eddy current at a place where the exciting coil 11 faces the heating roller 2. Therefore, heat generation of the part of the heating roller 2 corresponding to the center part A of the coil 11 is greater than the heat generation of the part of the heating roller 2 corresponding to the opening part B of the coil 11.

Accordingly, the temperature increase on the outer surface of the heating roller 2 is larger near A (the center part of the exciting coil 11) and is small near B (the opening part of the exciting coil 11) if the heating roller 2 is not rotated. Unevenness of the temperature on the outer circumferential surface in the circumferential direction thereof is eliminated by rotating both of the heating roller 2 and the press roller 3.

Figure 14:
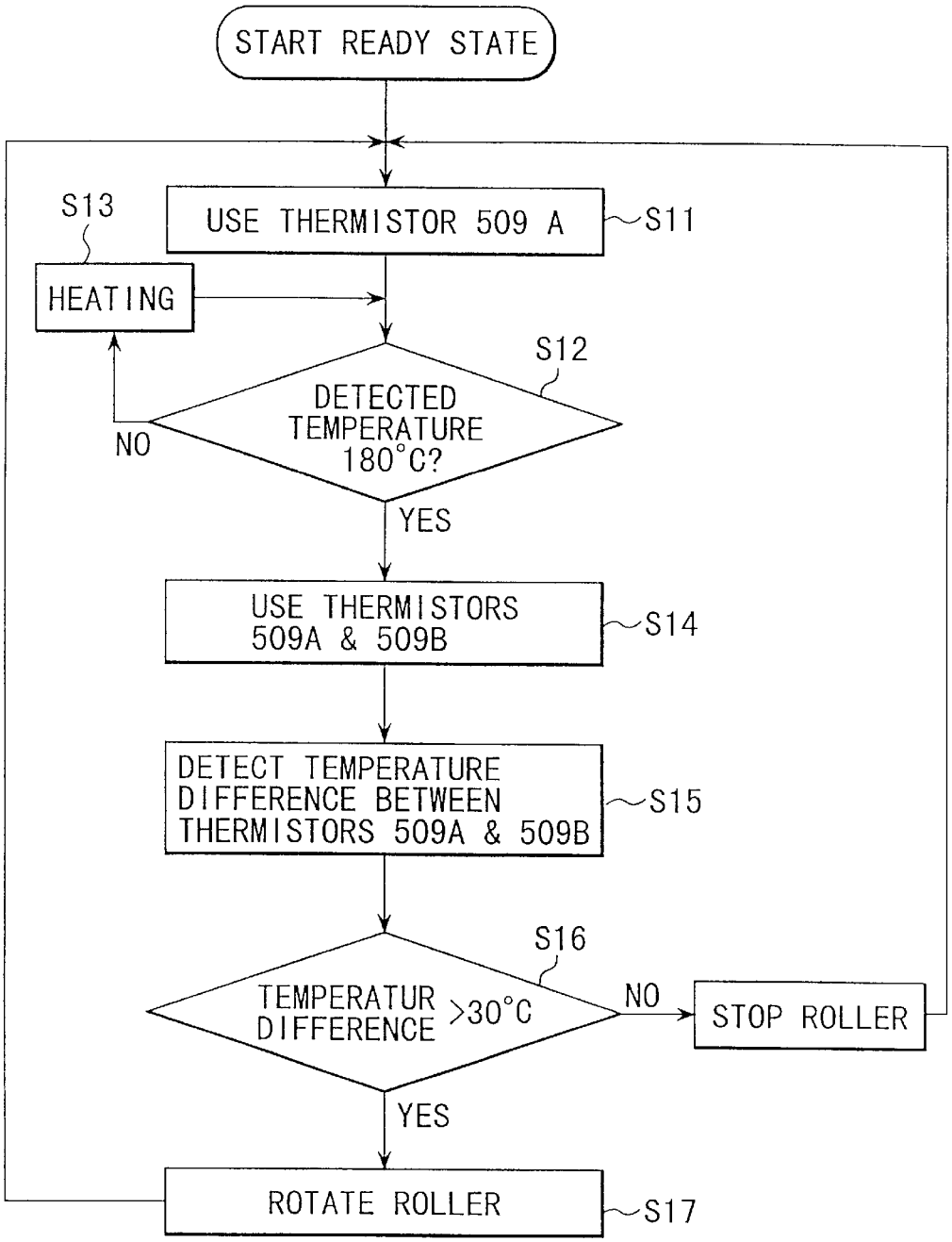
FIG. 14 is a flowchart which explains an example of drive control of the fixing device shown in FIG. 13.
Figure 15:
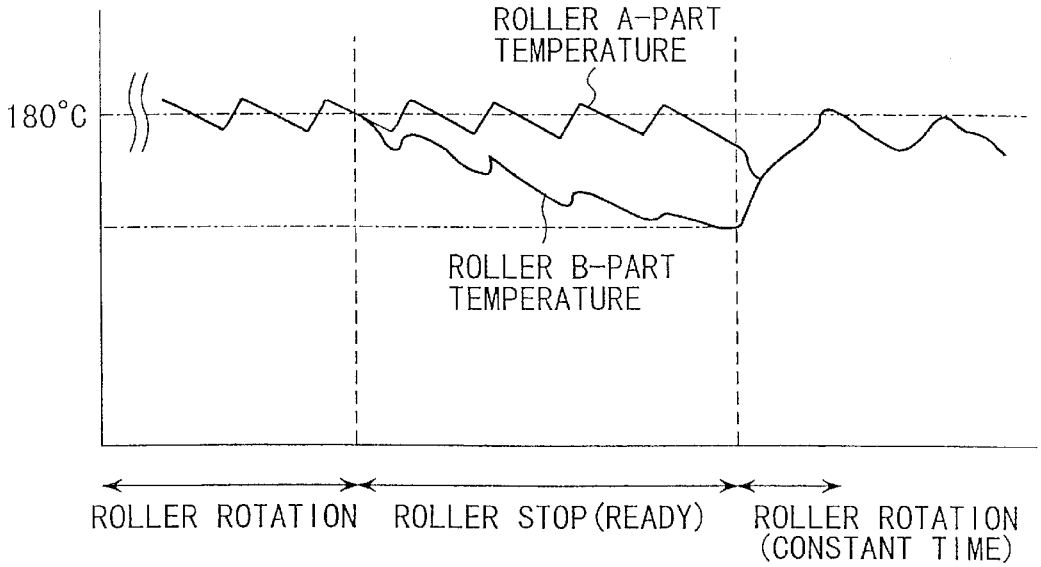
FIG. 15 is a graph which explains the temperature distribution of the fixing roller in a ready state of the fixing device shown in FIG. 13.

FIG. 14 is a flowchart explaining an example of control for driving the fixing device 501 shown in FIG. 13.

As shown in FIG. 14, when the heating roller 2 is in a ready state (after completion of warm-up), rotation of the roller 2 is stopped. Electric conduction to this exciting coil 11 at this time, i.e., the temperature control of the outer surface of the roller 2 is performed so as to heat the exciting coil 11 is heated (S13) such that the output value of the thermistor 509A is 180° C. (S12) by the thermistor 509A corresponding to the center part of the exciting coil If the output value of the thermistor 509A reaches 180° C., the output values of both the thermistors 509B and 509A are referred to (S14), and a temperature difference between the output values outputted from the thermistors, i.e., between both measurement points is detected (S15).

In the step S15, if the difference between the outputs of the first and second thermistors 509A and 509B reaches a predetermined temperature (30° C. in this case) (S16-YES), the heating roller 2 is rotated and the press roller 3 is rotated, slaved to the roller 2 (S17).

In contrast, if the difference between both thermistors 509A and 509B does not reach 30° C. (S16-NO), electric conduction (heating) to the exciting coil 11 is continued with both of the rollers kept stopped (S12 to S15).

This means that the temperature of the outer surface of the heating roller 2 is rendered uniform by rotating the heating roller 2, if the temperature of the outer surface of the heating roller 2 changes so that the difference the temperature of the roller 2 corresponding to the center part A of the exciting coil 11 and that corresponding to the opening part B of the exciting coil 11 becomes greater than a predetermined temperature.

Thus, both of the rollers 2 and 3 are rotated for a constant time, only if the difference between the temperatures at those positions on the outer surface of the heating roller 2 that face the center part and opening part of the exciting coil 11 reaches a constant value (e.g., 30°) or more. In this manner, the temperature of the heating roller 2 of the fixing device 501 is partially lowered, so that a waiting time for recovering the operation temperature is reduced upon a request for next fixing operation.

More specifically, heat generation of the roller 2 at the center part A of the exciting coil 11 is greater than the heat generation at the opening part B of the exciting coil 11, in a ready state in which the heating roller 2 stops rotation. Also, the temperature of the outer surface of the heating roller 2 is high near A and low near B, in this state. As a result, a temperature distribution difference is caused on the outer surface of the roller 2.

To eliminate this temperature distribution difference, the heating roller 2 may be rotated so that the temperature may be rendered uniform by the press roller 3. However, if the heating roller 2 and the press roller 3 are kept always rotated in a ready state (without heating operation), the temperature of the outer surface of the heating roller 2 decreases due to influences from the heat absorbed by the press roller 3. As a result of this, the power consumption is increased. Therefore, both of the rollers 2 and 3 are rotated for several seconds only when the temperature difference in the circumferential direction of the heating roller 2 reaches a constant value or more. The tolerable value of the temperature distribution difference caused on the outer surface of the heating roller 2 need only be such a temperature that renders the temperature of the outer surface of the heating roller 2 uniform at the operation temperature (180° C.) when a toner image formed by an image forming section not shown is fed by a paper P to the fixing device 501. Also, the tolerable value need only be capable of rendering the temperature of the outer surface of the heating roller 2 in a time period from when the a start button not shown is turned on to when a paper P holding toner reaches the fixing device 501. However, a temperature difference may exist on the outer surface of the roller 2 before the temperature of the outer surface of the heating roller 2 is rendered uniform.

Figure 16:
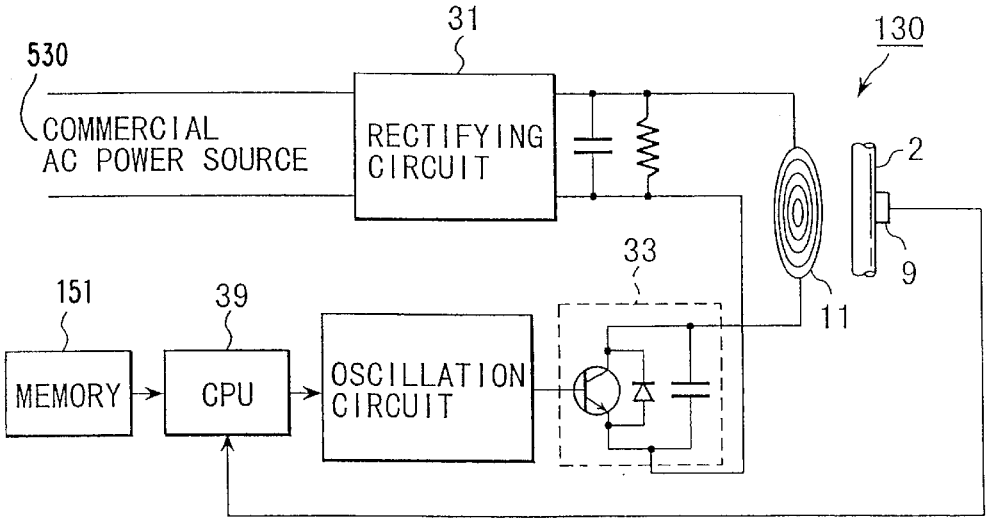
FIG. 16 is a schematic block diagram showing another embodiment of the drive circuit which drives each of the fixing devices explained with reference to FIGS. 2, 6, 8, 10, and 13.

FIG. 16 is a schematic block diagram explaining a drive circuit which drives various fixing devices as shown in FIGS. 2, 6, 10, and 13 but differs from the drive circuit shown in FIG. 4.

As shown in FIG. 16, the power source device 530 has a memory 151 which stores actually measured values concerning the gradient of increase of the surface temperature of the heating roller 2 while a drive current is supplied to the exciting coil 11 of the heating roller 2 (ON time) and the gradient of the decrease of the temperature at the time point when the drive current is shut off (OFF time). Based on the data stored in the memory 151, the power source device supplies the exciting coil 11 with drive currents for the starting (electric conduction) time, the ready state, and the sequential paper-passing period.

Since the sizes of the drive currents to be supplied to the exciting coil 11 are thus previously stored in the memory 151, the surface temperature of the heating roller 2 can start increasing at a constant gradient from the time point when supply of a drive current is started, and the temperature can fall within a range of data stored in the memory 151. However, if there can be an abnormality due to any reason, e.g., if the temperature of the exciting coil 11 remarkably increases to 240° C. or so, the abnormality of the exciting coil 11 can be detected by a temperature change of the outer surface of the heating roller 2.

That is, if any abnormality occurs in the exciting coil 11, the gradient of the temperature change on the outer surface of the heating roller 2 changes deviating from patterns (gradients of temperature increase) stored in the memory 151 while the exciting coil 11 is supplied with a drive current or at the time point when the drive current is stopped. That is, the temperature may increase more than the gradients stored during the ON-time, or the gradient of the temperature decrease becomes smaller during the OFF-time.

In this case, the abnormality may be considered as being caused by a temperature increase of the exciting coil 11, and electric conduction to the drive circuit can be stopped (the power source to the drive circuit can be shut off) if the temperature comes out of a defined value. Thus, without using a temperature detection mechanism such as a temperature sensor or the like, the temperature increase of the exciting coil 11 can be grasped by comparing the changes of the temperature on the outer surface of the heating roller 2 with the gradients of temperature increase (or temperature decrease) stored in the memory 151. Accordingly, the costs for the entire fixing device can be reduced.

As another method than the method of storing data concerning temperature increase gradients into the memory 151, for example, supply times (elapsed times from when the power source is turned on) of drive currents that can set the temperature of the outer surface of the heating roller 2 to a constant temperature may be stored into the memory 151 and may be compared with times of changes of the temperature on the outer surface of the heating roller 2, for example. In this case, if a drive current supply time (ON-time) is much shorter than expected, the exciting coil 11 can be considered as causing any trouble. That is, if the temperature increase on the outer surface of the heating roller 2 is sharp, it can be determined as an error of the exciting coil 11 and abnormal heat generation can be prevented by stopping the drive current supplied to the coil 11.

Figure 17:
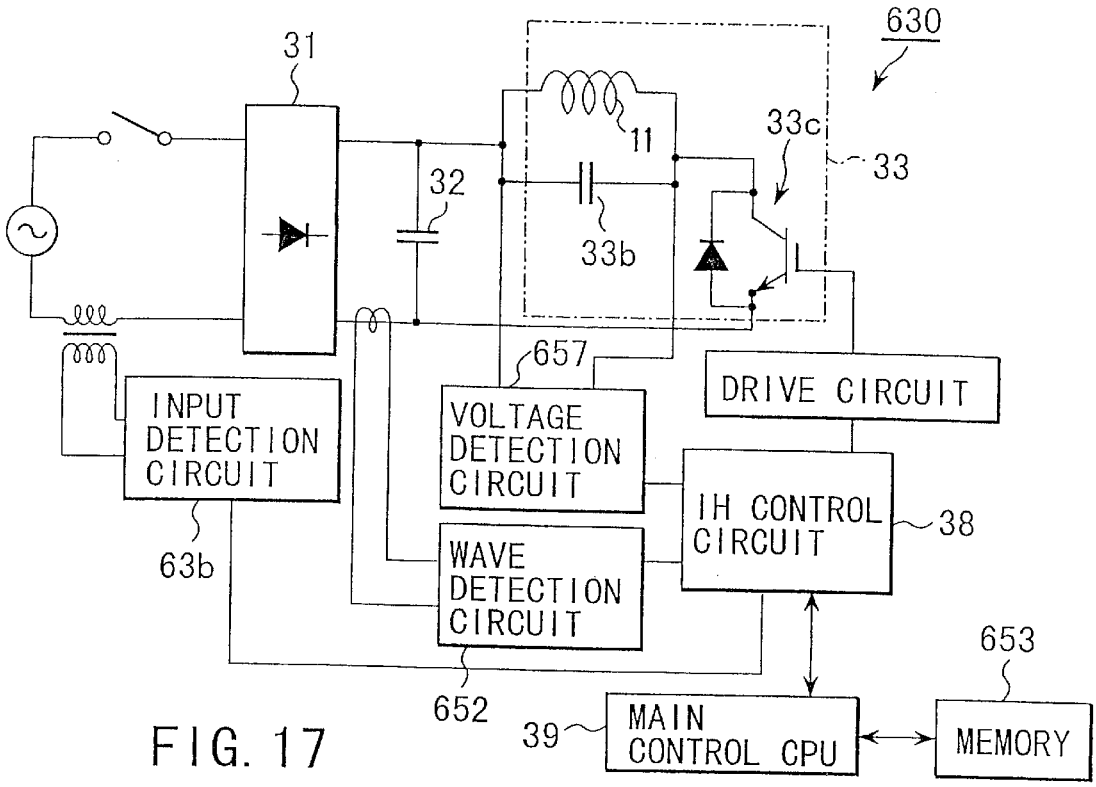
FIG. 17 is a schematic block diagram showing further another embodiment of the drive circuit applicable to each of the fixing devices explained with reference to FIGS. 2, 6, 8, 10, and 13.

FIG. 17 is a schematic block diagram explaining a drive circuit applicable to the fixing devices explained above. An example of a drive circuit in a well-known induction heating fixing device will be explained as a comparative example with reference to FIG. 18.

As shown in FIG. 17, the drive circuit 630 according to the present invention rectifies an alternating current from a commercial power source by a rectifying circuit 31 and a smoothing capacitor 32. This drive circuit 630 includes an inverter circuit 33 and an input detector 63*b*. The inverter circuit 33 is in electrical communication with coil 11, and includes a resonance capacitor 33*b*, and a switching circuit 33*c*. The input detector 63*b* is arranged in the front side of an IH control circuit 38 and monitors the power in the primary side, which is inputted to the rectifying circuit 31.

This input detector 63*b* matches values of a current and a voltage with each other, which are respectively detected by a wave detection circuit 652 which monitors the power amount in the primary side before rectification to detect a current after rectification, and a voltage detection circuit 657 which detects the voltage after rectification. The input detector stores the values into the memory 653.

In this manner, accurate values can be fed back, so that correction is realized in the stating period (start of electric conduction) even if the relative positions of the exciting coil 11 and the heating roller 2 are shifted relatively to each other due to a vibration or the like. Therefore, the output value can be prevented from being changed.

Figure 18:
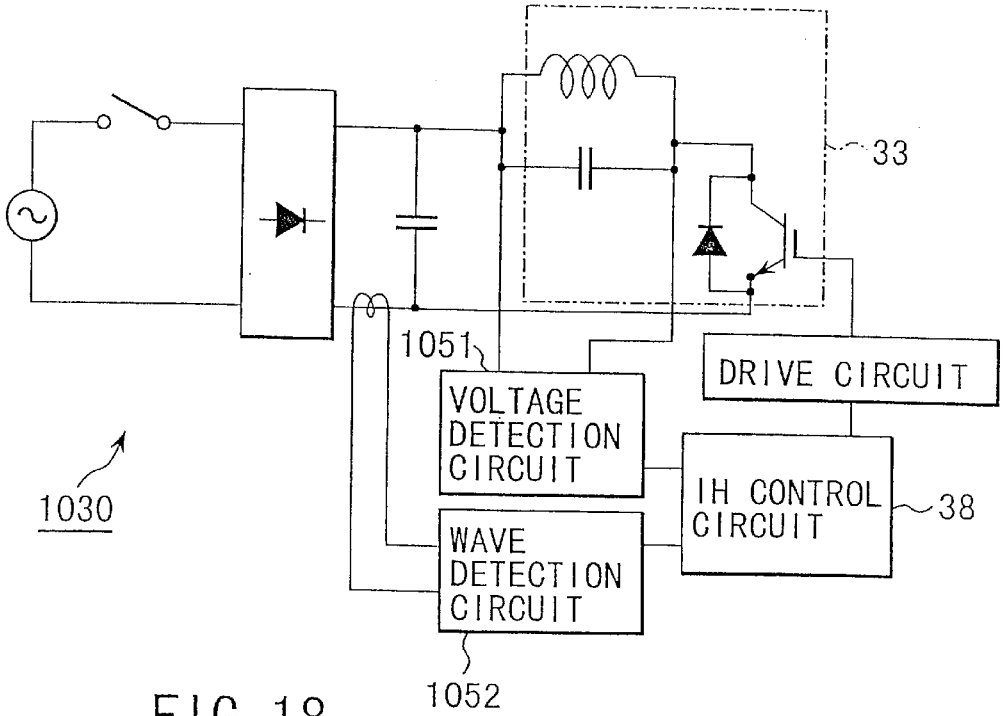
FIG. 18 (PRIOR ART)
FIG. 18 is a schematic block diagram which explains an example of a drive circuit in a well-known induction-heating fixing device.

In contrast, in a well-known drive circuit 1030 as shown in FIG. 18, a constant output is maintained by detecting the output (power). Therefore, this drive circuit generally adopts feedback control based on an output detected from a high-frequency current after rectification by a current detection circuit 1051 and an output detected from the same high-frequency current by a voltage detection circuit 1052.

In this case, the voltage detected by the voltage detection circuit 1052 is equivalent to the terminal voltage of the exciting coil, and the current detected by the current detection circuit 1051 is the current that flows though the circuit. These voltage and current can be maintained to be constant.

However, in the well-known drive method shown in FIG. 18, it is impossible to grasp the absolute value of the output value which is maintained to be a constant output. The power in the primary side and the detected current and voltage values are merely matched only in the initial period. If the exciting coil 11 or the heating roller 2 is replaced due to any malfunction, the positional accuracy of the exciting coil 11 and the heating roller 2 and the permeability of the heating roller 2 are changed. As a result, the drive current flowing and voltage applied through the exciting coil 11 do not correspond to the power that is assumed to be generated, by the method of managing the output by detecting the coil voltage and current after rectification. Therefore, adjustment must be made with use of a watt-hour meter or the like.

Figure 19:
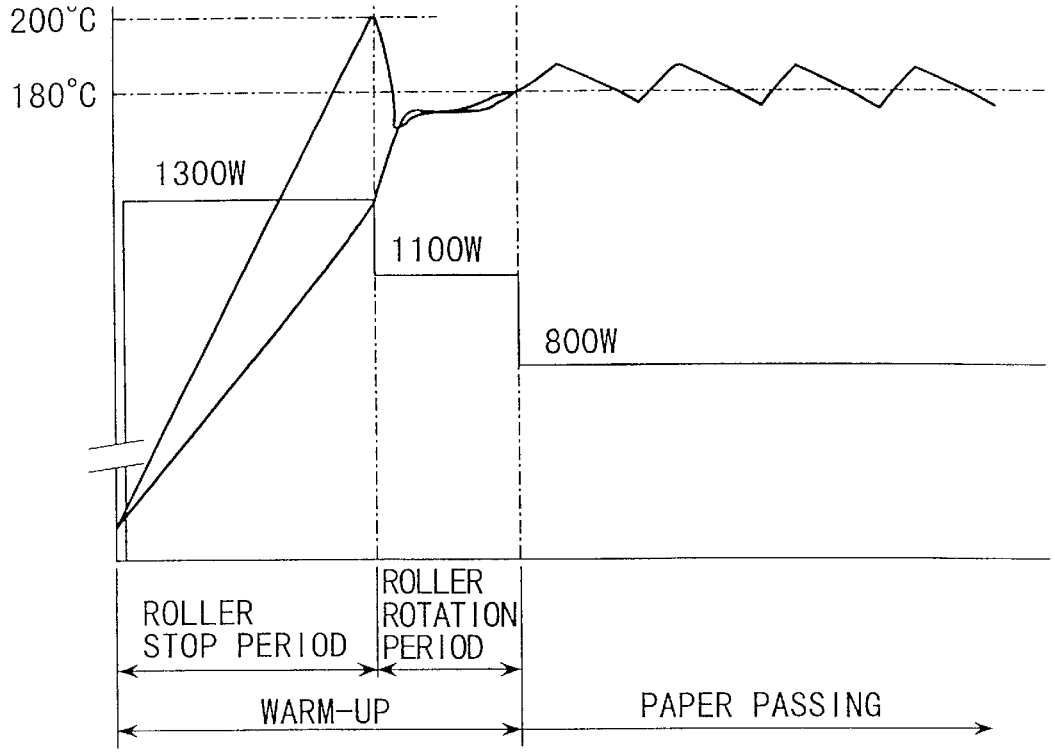
FIG. 19 is a timing chart explaining a relationship between the output and the size of a drive current which can be supplied to the exciting coil of each of the fixing devices explained with reference to FIGS. 2, 6, 8, 10, and 13.

FIG. 19 is a timing chart explaining the relationship between the output and the size of the drive current which can be supplied to the exciting coils of the fixing devices explained above.

As shown in FIG. 19, each of the heating roller 2 and the press roller 3 is not rotated (stopped) in the initial period of starting operation in the fixing device. Therefore, no power is consumed by a motor or the like, and accordingly, a larger output than that during a paper-passing period can be used to heat the exciting coil 11. Even at the time point when both the rollers 2 and 3 are rotated as warm-up proceeds, a larger output can be supplied to the exciting coil 11 since no power is consumed by a motor of a conveyance system or the like, compared with the period in which a paper is passing.

More specifically, all the power defined by subtracting the power amount consumed by other components in a copying machine not shown than the fixing device can be supplied to the exciting coil 11 in the initial period, supposing that a commercial power source of 1500 W, for example, as shown in FIG. 19. In the embodiments of the present invention, 1300 W is supplied to the exciting coil 11. Thereafter, the heating roller 2 and the press roller 3 are rotated from the middle of the starting period (i.e., from the time point when the temperature of the heating roller 2 exceeds 180° C.). As a result, in the present embodiment, 1100 W is supplied as a value defined by subtracting the powers consumed by motor rotation and by other processes.

Thus, in an induction-heating fixing device, the power supply amount is changed in accordance with a plurality of control patterns, so that the heating roller 2 can be heated efficiently.

To change the power amount to be supplied, in the drive circuit shown in FIG. 6, the time for which the switching element 38 is turned ON is changed by the IH control circuit 38, based on an IH control signal supplied as a 3-bit signal to the IH control circuit 38 from the main control CPU. The output value to be supplied to the exciting coil 11 is thus controlled. At this time, as the output is enlarged, the time for which the switching element 38 is turned ON is extended, and accordingly, the frequency of the output current is lowered.

Meanwhile, when a paper is passing, the output to the exciting coil 11 must be reduced as much as possible. That is, the least output necessary to maintain fixing performance is required. In the present embodiment, the output is 800 W when a paper is passing.

Thus, while a paper is passing (i.e., while an image is being formed), the high-frequency output of the fixing device can be reduced to be small, so that the power consumption can be reduced when a paper is passing.

Figure 20:
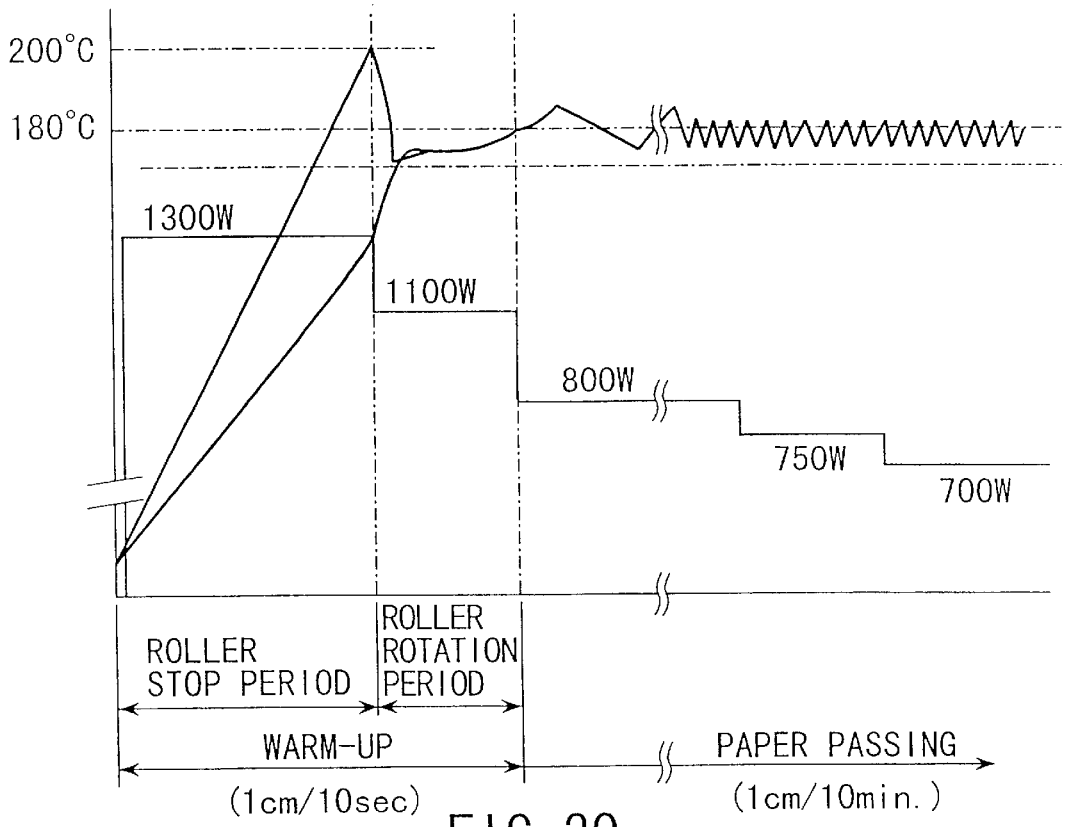
FIG. 20 is a timing chart explaining an example in which the output value is changed for every constant time unit during operation of sequentially passing papers.

FIG. 20 is a timing chart explaining an example in which the output value is changed for every constant time unit during the sequential paper-passing operation in a fixing device explained above, like the explanation made with reference to FIG. 19. That is, every time when a paper is sequentially and repeatedly let pass, heat is transmitted to the heating roller 3, and the temperature of the roller surface gradually increases. Every time when a unit time elapses, the supply amount of the drive current to the exciting coil 11 can be gradually lowered so that the temperature at the outer surface of the heating roller 2 might not change. In this case, as the temperature of the press roller 3 increases, the heat which escapes from the heating roller 2 to the press roller 3 decreases gradually. Therefore, the quantity of heat transmitted to the paper from the heating roller 2 increases, so that the fixing rate is not lowered.

Thus, if images are formed sequentially, heat is transmitted from the heating roller 2 to the press roller 3, so that the frequency of the output current, which is required to obtain an fixing rate substantially equal to that at the beginning of paper-passing operation and should be supplied to the exciting coil 11, can be reduced gradually. Hence, the power amount to be supplied to the exciting coil 11 can be reduced gradually through a plurality of steps of 800 W, 750 W, and 700 W. The power consumption is reduced accordingly. Since the temperature of the outer surface of the heating roller 2 is controlled to be constant, the applied power amount decreases naturally as the ON/OFF interval of the drive circuit itself changes. In conventional methods, changing of the drive frequency is not practiced but the ON/OFF timing of the drive circuit is changed to try to reduce the power consumption.

In contrast, in the present embodiment, the frequency of the current supplied to the exciting coil 11 is changed to reduce the power amount. In this manner, the maximum value of the current amount flowing through the exciting coil 11 is reduced, so that the temperature of the exciting coil 11 can be prevented from undesirably increasing.

Figure 21A:
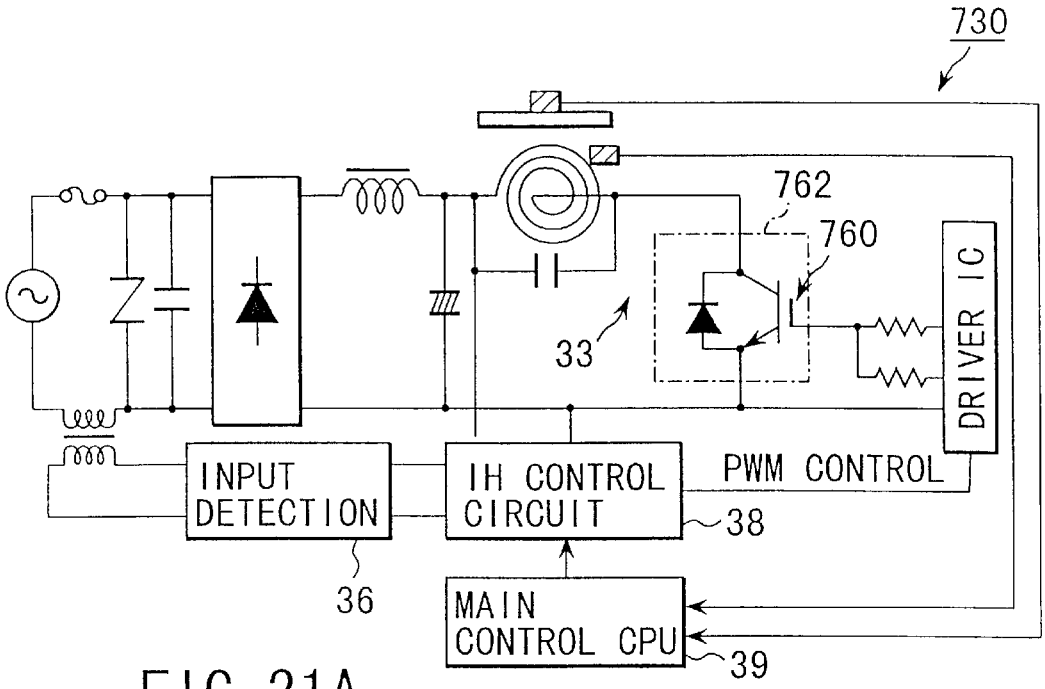
FIGS. 21A, 21B, and 21C are schematic block diagrams which explain further another embodiment of the drive circuit shown in FIG. 6.
Figure 21B:
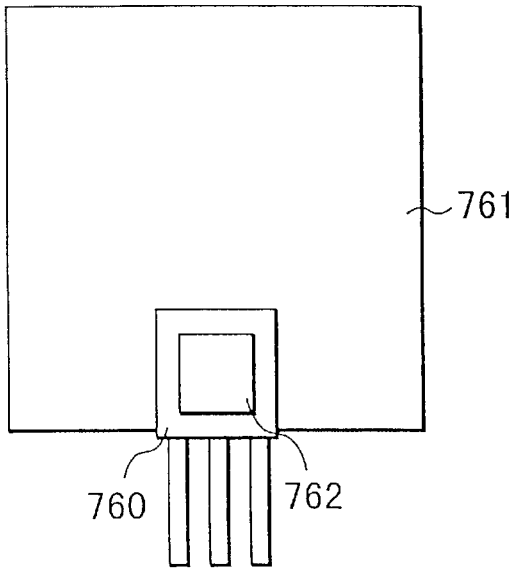
Figure 21C:
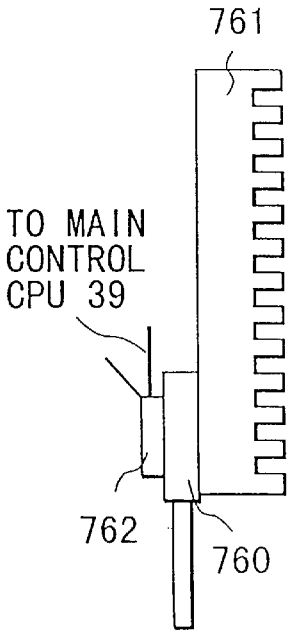

FIGS. 21A, 21B, and 21C show other embodiments of the drive circuits 30 explained above with reference to FIG. 6.

In the drive circuit 730 shown in FIG. 21A, a heat sink 761 for heat radiation and a thermistor 762 for temperature detection are attached to a predetermined heat radiation surface of the IGBT 760 as a transistor element forming part of a switching circuit.

Many transistor elements generate heat due to a flowing current and have a possibility to cause thermal runaway. Hence, the transistor (IGBT) 760 is provided with the thermistor 762 thereby to control the temperature of the IGBT 760. Temperature increase of the IGBT 760 is caused depending on both the amount and the time length of the flowing current. Therefore, it is tried to avoid flowing a current greater than a constant value for a long time. However, it is demanded for a fixing device used in a copying machine or the like to shorten the time for warm-up as much as possible, so the maximum power that can be electrically conducted must be supplied.

Hence, in the present embodiment, the surface temperature of the heating roller 2 and the temperature of the IGBT 760 are detected. When the temperature of the heating roller 2 is low, the IGBT 760 is supplied with the maximum current. This current is continuously maintained until the temperature of the IGBT 760 reaches to a temperature which does not cause thermal runaway. At the time point when the temperature of the heating roller 2 reaches a normal operation temperature, the current value flowing through the IGBT 760 is reduced. Needless to say, the current value supplied to the IGBT 760 is reduced earlier, if the temperature of the IGBT 760 reaches earlier to a defined temperature than the temperature of the heating roller 2 increases.

Thus, the temperature increases of the heating roller 2 and the transistor element are monitored respectively, when supplying a maximum current to the IGBT 710 (transistor element). As a result, thermal runaway of the transistor element can be prevented while supplying a larger current than a definition of a current value which has been conventionally considered as being flowable though a transistor element. In addition, not only the warm-up time can be shortened but also the present control method is effective for flowing a large current only during the warm-up time.

By thus heating the heating roller 2 by a large current, the warm-up time of the fixing device can be greatly reduced.

Figure 22:
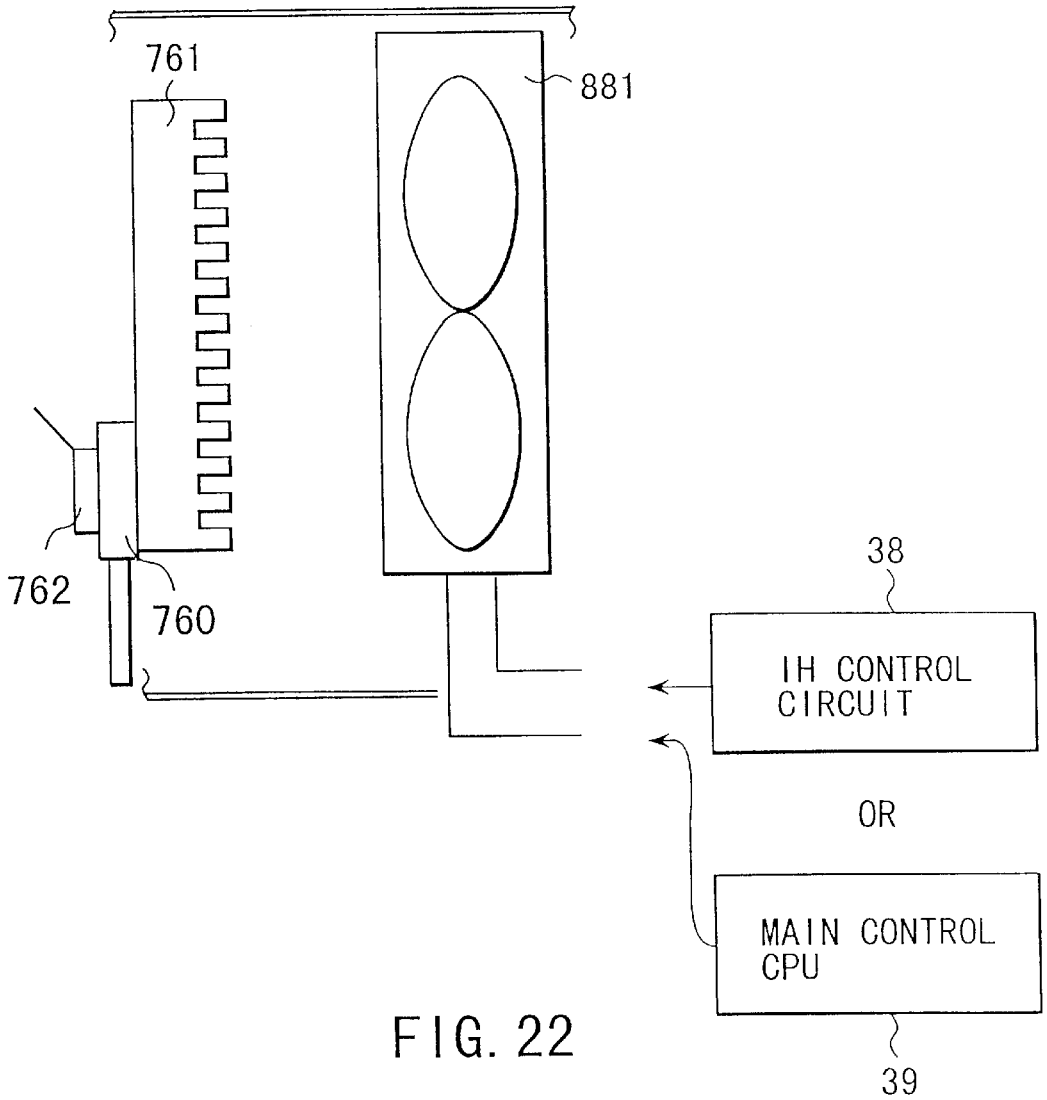
FIG. 22 is a schematic block diagram which explains further another embodiment of the drive circuit shown in FIGS. 21A, 21B, and 21C.

FIG. 22 is a schematic view which illustrates another embodiment of the drive circuit shown in FIGS. 21A, 21B, and 21C. The same structural components as those shows in FIGS. 21A, 21B, and 21C will be denoted at the same reference symbols as those in these figures. Detailed explanation of those components will be omitted herefrom.

In the drive circuit shown in FIG. 22, a heat sink 761 is attached to the IGBT 760 (transistor element), and cooling is further carried out by a fan 881. The fan 881 is driven in synchronization with start of electric conduction to the exciting coil. That is, the fan 881 is rotated at least while a high-frequency current is supplied to the exciting coil 11 under control by the main control CPU 39 or the IH control circuit 38.

According to this structure, the fan 881 only makes the least necessary operation. Therefore, the IGBT 760 can be efficiently cooled without undesirably increasing the power consumption.

The cooling fan 881 may be rotated for an appropriate time at an appropriate timing, based on a temperature obtained by measuring the temperature of the IGBT 760 by the thermistor 762.

In this case, only when the temperature of the IGBT 760 reaches a tolerable temperature, the fan 881 is driven. Accordingly, the power consumption of the entire copying machine can be much more reduced. In addition, both of stable switching and fin control can be achieved.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing device comprising:

an endless member having a metal layer made of a conductive material;

an electromagnetic induction coil provided near the endless member, for causing the endless member to generate heat by an alternating current applied to flow through the electromagnetic induction coil;

a rotation mechanism for rotating the endless member;

a rotation mechanism control section for selectively operating the rotation mechanism; and at least two coil temperature detection devices provided at a predetermined interval in a rotating direction of the metal layer of the endless member, for detecting a temperature of the electromagnetic induction coil.

2. A fixing device comprising:

an endless member having a metal layer made of a conductive material;

an electromagnetic induction coil provided near the endless member, for causing the endless member to generate heat by an alternating current applied to flow through the electromagnetic induction coil;

a rotation mechanism for rotating the endless member;

a rotation mechanism control section for selectively operating the rotation mechanism; and at least two metal layer temperature detection devices provided at a predetermined interval in the rotating direction of the metal layer of the endless member, for detecting a temperature of the metal layer.

3. A fixing device comprising:

an endless member having a metal layer made of a conductive material;

an electromagnetic induction coil provided near the endless member, for causing the endless member to generate heat by an alternating current applied to flow through the electromagnetic induction coil, the electromagnetic induction coil generating a predetermined temperature distribution in the endless member in relation to unevenness of a heat-generation distribution thereof;

a current control section for controlling the current flowing through the electromagnetic induction coil;

a rotation mechanism for rotating the endless member;

a rotation mechanism control section for selectively operating the rotation mechanism; and a metal-layer internal temperature detection device for detecting a temperature inside the metal layer, provided at a position inside the metal layer of the endless member or nearby, at which a temperature of the endless member becomes the highest when the endless member is not rotating.

4. A fixing device comprising:

an endless member having a metal layer made of a conductive material;

an electromagnetic induction coil provided near the endless member, for causing the endless member to generate heat by an alternating current applied to flow through the electromagnetic induction coil;

a current control section for controlling the current flowing through the electromagnetic induction coil;

a rotation mechanism for rotating the endless member; and a rotation mechanism control section for selectively operating the rotation mechanism, wherein the rotation mechanism control section energizes the rotation mechanism to rotate the endless member, after a temperature of the metal layer heated as a result of electric conduction to the electromagnetic induction coil reaches a higher temperature than a final setting temperature.

5. A fixing device comprising:

an endless member having a metal layer made of a conductive material;

an electromagnetic induction coil provided near the endless member, for causing the endless member to generate heat by an alternating current applied to flow through the electromagnetic induction coil;

a current control section for controlling the current flowing through the electromagnetic induction coil;

a rotation mechanism for rotating the endless member; and a rotation mechanism control section for selectively operating the rotation mechanism, wherein the current control section has a data table for storing temperature increase pattern data indicating a gradient of a temperature of an outer surface of the endless member that increases from a time point when a supply of a drive current to the electromagnetic induction coil is started and temperature decrease pattern data indicating a gradient of a temperature of the outer surface of the endless member that decreases from a time point when a supply of a drive current to the coil is stopped, each of the pattern data stored in the data table is associated with a temperature of a wire of the coil, and the current control sections shuts off electric conduction to the coil if one of the temperature increase and decrease of the endless member deviates from the pattern data stored in the data table.

6. A fixing device comprising:

an endless member having a metal layer made of a conductive material;

an electromagnetic induction coil provided near the endless member, for causing the endless member to generate heat by an alternating current applied to flow through the electromagnetic induction coil;

a current control section for controlling the current flowing through the electromagnetic induction coil;

a rotation mechanism for rotating the endless member; and a rotation mechanism control section for selectively operating the rotation mechanism, wherein the current control section has a data table in which a time required for a temperature of an outer surface of the endless member to reach a predetermined temperature from a time point when a supply of a drive current to the electromagnetic induction coil is started is associated with pattern data indicating a gradient of a temperature increase of the endless member, and the current control section shuts off electric conduction to the electromagnetic induction coil if the temperature increase deviates from the pattern data indicating the gradient of the temperature increase stored in the data table.

7. A fixing device comprising:

an endless member having a metal layer made of a conductive material;

an electromagnetic induction coil provided near the endless member, for causing the endless member to generate heat by an alternating current applied to flow through the electromagnetic induction coil;

a current control section for controlling the current flowing through the electromagnetic induction coil;

a rotation mechanism for rotating the endless member; and a rotation mechanism control section for selectively operating the rotation mechanism, wherein the current control section includes a feedback control system for checking whether or not an output corresponding to a predetermined setting value is outputted (constantly) to each of the electromagnetic induction coil and the metal layer of the endless member.

8. The apparatus according to claim 7, wherein the current control section can change a power amount, which is being electrically conducted, through a plurality of steps in accordance with a plurality of power control patterns.

9. A fixing apparatus according to claim 7, wherein the feedback control system checks whether or not an output corresponding to a predetermined setting value is constantly outputted from the electromagnetic induction coil to the metal layer of the endless member, and wherein the feedback control system performs a feedback control by detecting a current and a voltage preceding a rectifying circuit.

10. A fixing device comprising:

an endless member having a metal layer made of a conductive material;

an electromagnetic induction coil provided near the endless member, for causing the endless member to generate heat by an alternating current applied to flow through the electromagnetic induction coil;

a current control section for controlling the current flowing through the electromagnetic induction coil;

a rotation mechanism for rotating the endless member; and a rotation mechanism control section for selectively operating the rotation mechanism, wherein the current control section detects a temperature of a surface of the metal layer of the endless member and a temperature of a switching element for supplying a current to the electromagnetic induction coil, and switches an operation mode, based on each of the detected temperatures.

11. An image forming apparatus comprising:

a photosensitive member for holding a latent image corresponding to an image to be outputted;

a developing device for selectively supplying a visualizing agent to the latent image held by the photosensitive member, thereby to form a visualizing-agent image corresponding to the latent image, on the photosensitive member;

a transfer device for transferring the visualizing-agent image formed by the developing device to a transfer medium from the photosensitive member; and a fixing device including a first endless member which has a cylindrical or belt-like shape and includes a conductive part, a second endless member which has a cylindrical or belt-like shape, includes a conductive part, and contacts an arbitrary point in a circumferential direction of the first endless member, a coil member provided inside at least one of the first and second endless members, for generating an eddy current at the conductive part of the at least one of the endless members, the coil member making no contact with an inner surface of the at least one of the endless member, at least two temperature detection devices provided at a predetermined interval in a rotating direction of a metal layer of the at least one of the endless members, for detecting a temperature of the electro magnetic induction coil or a temperature of the metal layer, a power source circuit connected with an external power source and capable of supplying a current having a predetermined frequency to the coil member, a current control section for controlling a size (frequency) of the current supplied to the coil member from the power source circuit, and electric-conduction/shut-off of the coil member, a rotation mechanism for rotating the endless members, and a rotation mechanism control section for selectively controlling the rotation mechanism, wherein the visualizing-agent image transferred to the transfer medium by the transfer device and the transfer medium are heated and pressed between the first and second endless members.

12. An image forming apparatus comprising:

a photosensitive member for holding a latent image corresponding to an image to be outputted; and a developing device for selectively supplying a visualizing agent to the latent image held by the photosensitive member, thereby to form a visualizing-agent corresponding to the latent image, on the photosensitive member;

a fixing device including:

an endless member which has a cylindrical or belt-like shape and includes a conductive part;

an electromagnetic induction coil, provided near the endless member, for causing the endless member to generate heat by an alternating current applied to flow through the electromagnetic induction coil, the electromagnetic induction coil generating a predetermined temperature distribution in the endless member in relation to unevenness of a heat-generation distribution thereof;

a current control section for controlling the current flowing through the electromagnetic induction coil, the current control section having a plurality of power control modes for respective operation modes, power being set in each of the power control modes to satisfy the relationship, wherein the current control section includes a feedback control system for checking whether or not an output corresponding to a predetermined setting value is outputted (constantly) to reach of the electromagnetic induction coil and the metal layer of the endless member.

13. A fixing device comprising:

an endless member having a metal layer made of a conductive material;

an electromagnetic induction coil provided near the endless member, for causing the endless member to generate heat by an alternating current applied to flow through the electromagnetic induction coil, the electromagnetic induction coil generating a predetermined temperature distribution in the endless member in relation to unevenness of a heat-generation distribution thereof;

a current control section for controlling the current flowing through the electromagnetic induction coil;

a rotation mechanism for rotating the endless member;

a rotation mechanism control section for selectively operating the rotation mechanism; and a metal-layer internal temperature detection device for detecting a temperature inside the metal layer, provided at a position inside the metal layer of the endless member or nearby, at which a magnetic flux acting on the endless member is the maximum when the endless member is not rotating.

14. A fixing device comprising:

an endless member having a metal layer made of a conductive material;

an electromagnetic induction coil provided near the endless member, for causing the endless member to generate heat by an alternating current applied to flow through the electromagnetic induction coil;

a current control section for controlling the current flowing through the electromagnetic induction coil, the current control section having a plurality of power control modes for respective operation modes, power being set in each of the power control modes to maintain the average temperature of the endless member substantially equal to the fixing control temperature;

a rotation mechanism for rotating the endless member; and a rotation mechanism control section for selectively operating the rotation mechanism.

15. A fixing device comprising:

an endless member having a metal layer made of a conductive material;

an electromagnetic induction coil provided near the endless member, for causing the endless member to generate heat by an alternating current applied to flow through the electromagnetic induction coil;

a current control section for controlling the current flowing through the electromagnetic induction coil;

a rotation mechanism for rotating the endless memeber; and a rotation mechanism control section for selectively operating the rotation mechanism, wherein the rotation mechanism control section energizes the rotation mechanism to rotate the endless member, after a temperature difference in a circumferential direction of the metal layer of the endless member reaches a value equal to or higher than a constant value during a ready period in which the electromagnetic induction coil is electrically conducted.

* * * * *